US010647011B2

(12) United States Patent
Robinson et al.

(10) Patent No.: US 10,647,011 B2
(45) Date of Patent: May 12, 2020

(54) NETWORKED SHAVING APPLIANCE SYSTEM

(71) Applicant: The Gillette Company LLC, Boston, MA (US)

(72) Inventors: Susan Clare Robinson, Windsor (GB); Balasundram Periasamy Amavasai, Reading (GB); Matthew Lloyd Barker, Mason, OH (US); Kate Budds, Reading (GB); Ian Anthony Good, Reading (GB); Robert Hinkle, Cincinnati, OH (US); Faiz Feisal Sherman, Mason, OH (US); Nigel Weston, Reading (GB); Matthew Stephen Bauer, Loveland, OH (US)

(73) Assignee: THE GILLETTE COMPANY LLC, Boston, MA (US)

( * ) Notice: Subject to any disclaimer, the term of this patent is extended or adjusted under 35 U.S.C. 154(b) by 0 days.

(21) Appl. No.: 15/875,531

(22) Filed: Jan. 19, 2018

(65) Prior Publication Data

US 2019/0224868 A1 Jul. 25, 2019

(51) Int. Cl.

| | |
|---|---|
| ***B26B 21/40*** | (2006.01) |
| ***B26B 21/52*** | (2006.01) |
| ***B26B 21/10*** | (2006.01) |

(52) U.S. Cl.

CPC ..... *B26B 21/4056* (2013.01); *B26B 21/10* (2013.01); *B26B 21/4081* (2013.01); *B26B 21/4087* (2013.01); *B26B 21/526* (2013.01)

(58) Field of Classification Search

CPC ..... B26B 21/526; B26B 21/40; B26B 21/42; B26B 21/4081; B26B 21/4056;

(Continued)

(56) References Cited

U.S. PATENT DOCUMENTS

| | | | |
|---|---|---|---|
| 6,189,215 | B1 | 2/2001 | Beerwerth et al. |
| 8,615,886 | B1 | 12/2013 | Childers |

(Continued)

FOREIGN PATENT DOCUMENTS

| | | | |
|---|---|---|---|
| EP | 2540189 | A1 | 1/2013 |
| EP | 3141151 | A1 | 3/2017 |

(Continued)

*Primary Examiner* — Ghassem Alie

(74) *Attorney, Agent, or Firm* — BakerHostetler

(57) ABSTRACT

A networked shaving appliance system includes: (a) a shaving appliance including a handle and a shaving head cartridge connected to the handle and motion, orientation, and/or pressure sensors associated with the handle and/or shaving head cartridge; (b) a sensor circuit connected to receive sensor signals and generate shave event information from the sensor signals; (c) a network circuit wirelessly connected with a computer network and communicating at least the shave event information to the computer network; and (d) a computerized tool operating, at least in part, on a computerized user device connected to the computer network. The computerized tool is configured to receive shave event data associated with a user of the computerized device from the computer network, receive user profile data from the user via a graphical user interface provided by the computerized tool, process the shave event data with the user profile data to generate user feedback information, and communicate the user feedback information to the user via the graphical user interface provided by the computerized tool.

16 Claims, 15 Drawing Sheets

(58) Field of Classification Search
CPC . B26B 21/405; B26B 19/382; B26B 21/4087; B26B 21/565; A46B 5/007; A46B 5/0062; A46B 13/02; A46B 15/0044; A46B 9/04; A46B 5/026; A61C 17/16; A61C 17/221; A45D 26/00
USPC ..... 83/13; 30/41, 41.8, 34.05, 131; 132/213, 132/214
See application file for complete search history.

(56) References Cited

U.S. PATENT DOCUMENTS

| | | | | |
|---|---|---|---|---|
| 9,126,346 | B2 | 9/2015 | Meier et al. | |
| 9,174,351 | B2 * | 11/2015 | Binder | A45D 26/00 |
| 2008/0168657 | A1 | 7/2008 | Cloke et al. | |
| 2008/0189953 | A1 | 8/2008 | Jessemey et al. | |
| 2009/0056141 | A1 | 3/2009 | Barry et al. | |
| 2011/0010875 | A1 | 1/2011 | Iwahori et al. | |
| 2011/0018985 | A1 * | 1/2011 | Zhu | A45D 44/00 348/61 |
| 2012/0167392 | A1 | 7/2012 | Cherian et al. | |
| 2014/0137883 | A1 | 5/2014 | Rothschild | |
| 2015/0183118 | A1 | 7/2015 | Roth | |
| 2015/0205279 | A1 | 7/2015 | Simeth | |
| 2016/0046028 | A1 | 2/2016 | Meier et al. | |
| 2016/0143718 | A1 * | 5/2016 | Serval | A46B 15/0004 15/22.1 |
| 2016/0167241 | A1 * | 6/2016 | Goldfarb | B26B 21/4056 382/108 |
| 2016/0262521 | A1 | 9/2016 | Kustra et al. | |
| 2016/0263755 | A1 | 9/2016 | De Bulten et al. | |
| 2017/0079421 | A1 * | 3/2017 | Tamminga | A61C 1/0015 |
| 2017/0097758 | A1 | 4/2017 | Bauer et al. | |
| 2017/0232624 | A1 | 8/2017 | King | |
| 2017/0303673 | A1 * | 10/2017 | Van Gool | A46B 15/0022 |
| 2017/0305023 | A9 | 10/2017 | Ball et al. | |
| 2018/0132603 | A1 * | 5/2018 | Gatzemeyer | A46B 5/026 |
| 2018/0160796 | A1 * | 6/2018 | Jeanne | A46B 15/0006 |
| 2018/0236675 | A1 | 8/2018 | Westerhof et al. | |
| 2019/0191850 | A1 | 6/2019 | Yoganandan et al. | |
| 2019/0200746 | A1 * | 7/2019 | Serval | A46B 15/0006 |
| 2019/0251860 | A1 | 8/2019 | Lawrenson et al. | |

FOREIGN PATENT DOCUMENTS

| | | | |
|---|---|---|---|
| WO | WO 2009/076415 | A2 | 6/2009 |
| WO | WO 2013/061214 | A1 | 5/2013 |

* cited by examiner

NETWORKED SHAVING APPLIANCE SYSTEM

The current application is related to U.S. patent application Ser. Nos. 15/875,180, 15/875,557, 15/875,581, 15/875,200, 16/251,535 and 16/245,730. Each of these applications are incorporated herein by reference in their entirety. The relationship of these applications should be recognized for purposes of prior art consideration.

FIELD OF THE INVENTION

The current disclosure relates to "smart" or network-connected shaving/razor devices and more particularly to a razor device and system having the ability to improve the usage experience of the razor device by exchanging information about the shaving experience to the user related to the razor device.

BACKGROUND OF THE INVENTION

There are numerous personal appliances used by consumers every day. Examples of such personal appliances include but are not limited to shaving razors and electric shavers. Proper usage techniques of such personal appliances facilitate the overall efficacy of the product providing the user with a more positive experience than he or she would have otherwise experienced. Such positive usage experiences will likely lead to continued product usage. Providing the user with information about proper usage techniques for using personal appliance has been limited.

Razors with sensors have been used to provide information to the user. Razors with proximity sensors or cameras have been used to provide information on blade attrition. Razors with force sensors have been used to provide the user with information on the amount of force being applied to the skin. By tracking the force being applied during the shave provides a metric to gauge blade dulling and predict blade attrition. Razors having sensors to count shaving strokes have been used to again assist with blade attrition. Cameras have been used to provide users with boundary indicators such as distinguishing between areas of long hair such as side burns adjacent to areas of shorter hair length.

While these existing sensors do assist in providing the user with some basic information they fall well short of providing the usage information needed for an improved shave. To provide the user with the necessary usage information for an improved shave, the razor or personal appliance needs to have sensors that provide the user with useful information and/or data about the user's shave. With the useful information and/or data about user's shave the user can see how he or she is shaving and can discover ways to improve the shave.

SUMMARY OF THE INVENTION

It is an aspect of the current disclosure to provide a networked shaving appliance system that includes: (a) a shaving appliance including, a handle and a shaving head cartridge connected to the handle; one or more motion, orientation, and pressure sensors associated with one or more of the handle and shaving head cartridge; and a sensor circuit connected via a data connection to receive sensor signals from the one or more motion, orientation and pressure sensors, the sensor circuit generating shave event information from the sensor signals; (b) a network circuit wirelessly connected with a computer network, and communicating at least the shave event information to the computer network; and (c) a computerized tool operating, at least in part, on a computerized user device connected to the computer network, the computerized tool configured to: receive shave event data associated with a user of the computerized device from the computer network, receive user profile data from the user via a graphical user interface provided by the computerized tool, process the shave event data with the user profile data to generate user feedback information, and communicate the user feedback information to the user via the graphical user interface provided by the computerized tool.

In a more detailed embodiment, the sensor circuit further generates new-cartridge event information and the sensor circuit compiles cumulative shave event data occurring since the generation of the new-cartridge event information. In a further detailed embodiment, the sensor circuit and/or the computerized tool generates blade wear information based, at least in part, upon the cumulative shave event data. In a further detailed embodiment, the computerized tool processes the blade wear information with the user profile data to generate user feedback information. In a further detailed embodiment, the user profile data includes shaving problem issues identified by the user and the user feedback information includes suggestions for addressing the shaving problem issues determined at least in part upon the blade wear information. In a further detailed embodiment, the user profile information received from the user includes hair growth direction information; the sensor circuit generates shave stroke direction information from the sensor signals; and the computerized tool generates user feedback information based further upon the shave stroke direction information with respect to the hair growth direction information. In yet a further detailed embodiment, the user feedback information includes suggestions for addressing the shaving problem issues determined at least in part upon the blade wear information in combination with the shave stroke direction information with respect to the hair growth direction information.

Alternatively, or in addition, the sensor circuit segments at least some of the shave event information based upon one of a plurality of facial regions (e.g., cheek region(s), neck region(s), chin region(s) and/or lip region(s)) in which the sensor signals were generated, and identifies facial regions associated with at least some of the shave event information; at least some of the user profile data is segmented based upon the plurality of facial regions; and the computerized tool generates user feedback information based, at least in part upon facial regions identified in the shave event information.

In another aspect of the current disclosure, a method for transforming sensor data from a shaving appliance into user recommendation information, includes the steps of: (a) providing a shaving appliance including, a handle and a shaving head cartridge connected to the handle, and one or more motion, orientation, and pressure sensors associated with one or more of the handle and shaving head; (b) receiving the sensor signals; (c) generating shave event information from the sensor signals; (d) communicating at least the shave event information to a global computer network; (e) receiving user profile data associated with a user of the shaving appliance; (f) processing the shave event data with the user profile data to produce user feedback information customized to the user profile data; and (g) communicating the user feedback information to a user associated with the user profile data.

In a more detailed embodiment, the method further includes a step of producing new cartridge detection information; and the generating step compiles cumulative shave event data occurring since the production of the new cartridge detection information. In a further detailed embodiment, the method further includes a step of generating blade wear information from the cumulative shave event data. In a further detailed embodiment, the processing step processes the blade wear information with the user profile data to produce user feedback information customized with the user profile data. In yet a further detailed embodiment, the user profile data includes shaving problem issues identified by the user and the user feedback information includes suggestions for addressing the shaving problem issues determined at least in part upon the blade wear information. In yet a further detailed embodiment, the user profile information includes hair growth direction information; the generating step generates shave stroke direction information from the sensor signals; and the processing step produces user feedback information based further upon the shave stroke direction information with respect to the hair growth direction information. In yet a further detailed embodiment, the processing step processes the blade wear information in combination with the shave stroke direction information with respect to the hair growth direction information to produce the user feedback information. Alternatively, or in addition, the user profile information includes hair growth direction information; the generating step generates shave stroke direction information from the sensor signals; and the processing step produces user feedback information based further upon the shave stroke direction information with respect to the hair growth direction information.

In an alternate embodiment of the current aspect, the method further includes a step of segmenting at least some of the shave event information according to a plurality of facial regions; the generating step identifies facial regions associated with at least some of the shave event information; at least some of the user profile data is segmented based upon the plurality of facial regions; and the processing step produces user feedback information based, at least in part upon facial regions identified in the shave event information.

It is another aspect of the current disclosure to provide a shaving appliance that includes: a handle and a shaving head cartridge connected to the handle; motion, orientation, and/or pressure sensors associated with the handle and/or shaving head cartridge; cartridge ejection and/or new-cartridge installation sensor(s); a sensor circuit connected via a data connection to receive sensor signals from the motion, orientation and/or pressure sensors, and from the cartridge ejection and/or new-cartridge installation sensor(s), the sensor circuit generating cumulative shave event information from the sensor signals, the cumulative shave event information accumulating shave event information upon receiving either a cartridge ejection signal from the cartridge ejection sensor(s) or a cartridge installation signal from the new-cartridge installation sensor(s); and a notification circuit communicating cumulative shave event information to a user. In an alternate aspect, a shaving appliance includes: a handle and a shaving head cartridge connected to the handle; a plurality of sensors provided in one or more of the shaving head and handle, including, an accelerometer sensing acceleration in three dimensions of at least one of the shaving head and handle, a gyroscope sensing an angle of at least one of the shaving head and handle, a magnetometer sensing a relational position of at least one of the shaving head and handle, and a pressure sensor sensing pressure with respect to at least one of the shaving head and handle; a sensor circuit connected via a data connection to receive sensor signals from the accelerometer, gyroscope, magnetometer and pressure sensor, the sensor circuit generating a new-cartridge event based upon at least one of the sensor signals and generating cumulative shave event information from a plurality of the sensor signals, the cumulative shave event information accumulating shave event information upon the generation of the new-cartridge event; and a notification circuit communicating cumulative shave event information to a user.

In a further detailed embodiment, the notification circuit is contained within the handle, and includes at least one illumination device connected thereto; and the notification circuit activates the illumination device depending upon the cumulative shave event information. In a further detailed embodiment, the illumination device illuminates at least one of a plurality of different colors depending upon the cumulative shave event information. Alternatively, or in addition, the illumination device illuminates in at least one of a plurality of different illumination levels depending upon the cumulative shave event information.

In a further detailed embodiment, the handle further includes a rechargeable power supply and a charging circuit; the shaving appliance further includes a powered base for seating the handle and providing electrical charge to the charging circuit; and the notification circuit is contained within the powered base. In a further detailed embodiment, the notification circuit includes at least one illumination device connected thereto, and the notification circuit activates the illumination device depending upon the cumulative shave event information. In yet a further detailed embodiment, the illumination device illuminates at least one of a plurality of different colors depending upon the cumulative shave event information. Alternatively, or in addition the illumination device illuminates in at least one of a plurality of different illumination levels depending upon the cumulative shave event information. Alternatively, or in addition, the notification circuit includes at least one graphic display connected thereto, and the notification circuit activates the graphic display to display at least one of text and graphic information depending upon the cumulative shave event information. Alternatively, or in addition, the notification circuit includes at least one sound emitting device connected thereto, and the notification circuit activates the sound emitting device depending upon the cumulative shave event information.

In yet a further detailed embodiment, the shaving appliance further includes a network circuit wirelessly connected with a computer network and communicates the cumulative shave event information to the computer network; the shaving appliance further includes a computerized tool operating, at least in part, on a computerized user device connected to the computer network, the computerized tool providing a graphical user interface on the computerized device, the computerized tool configured to: receive cumulative shave event data associated with a user of the computerized device from the wireless computer network, process the cumulative shave event data to generate user feedback information, and communicate the user feedback information to the user via the graphical user interface. In a further detailed embodiment, the computerized tool is further configured to receive user profile data from the user via the graphical user interface, and process the cumulative shave event data with the user profile data to generate user feedback information customized for the user profile data. In a further detailed embodiment, the user profile data includes shaving problem issues identified by the user and the user feedback information includes suggestions for addressing the shaving problem issues determined at least in part upon the blade wear information. Alternatively, or in addition, the user profile information received from the user includes hair growth direction information; the sensor circuit generates shave stroke direction information from the sensor signals; and the computerized tool generates user feedback information based further upon the shave stroke direction information with respect to the hair growth direction information. Alternatively, or in addition, the user feedback information includes suggestions for addressing the shaving problem issues determined at least in part upon the blade wear information in combination with the shave stroke direction information with respect to the hair growth direction information. Alternatively or in addition, the sensor circuit segments at least some of the cumulative shave event information based upon one of a plurality of facial regions in which the sensor signals were generated, and identifies facial regions associated with at least some of the cumulative shave event information; at least some of the user profile data is segmented based upon the plurality of facial regions; and the computerized tool generates user feedback information based, at least in part upon facial regions identified in the cumulative shave event information.

It is another aspect of the current disclosure to provide a shaving appliance that includes: (a) a handle and a shaving head connected to the handle; (b) a plurality of sensors provided in one or more of the shaving head and handle, including at least two of (or at least three of; or all of) an accelerometer sensing acceleration in three dimensions of at least one of the shaving head and handle, a gyroscope sensing an angle of at least one of the shaving head and handle, a magnetometer sensing a relational position of at least one of the shaving head and handle, and a pressure sensor sensing pressure with respect to at least one of the shaving head and handle; (c) a sensor circuit connected via a data connection to receive sensor signals from the at least two of the accelerometer, gyroscope, magnetometer and pressure sensor, the sensor circuit generating shave stroke direction information from the sensor signals; and (d) a notification circuit determining relative shave stroke direction information for a user from the shave stroke direction information and from hair growth direction information electronically stored with respect to the user.

In a more detailed embodiment, the notification circuit is remote from the handle and shaving head, and receives the shave stroke direction information from a global computer network. In a further detailed embodiment, the notification circuit is remote from the handle and the shaving head, and receives the shave stroke direction information via a wireless data connection. Alternatively, or in addition, the hair growth direction information is stored remotely from the handle and the shaving head. Alternately, or in addition, the hair growth information is collected through a graphical user interface operating on a networked computer device wirelessly connected to a global computer network. Alternatively, or in addition, the hair growth information is stored with user profile information for the user.

Alternatively, or in addition, the shaving appliance further includes (e) a network circuit wirelessly connected with a computer network, communicating (i) the shave stroke direction information and/or (ii) the relative shave stroke direction information to the computer network; and (f) a computerized tool operating, at least in part, on a computerized user device connected to the computer network, the computerized tool communicating (a) the relative shave stroke direction information and/or (b) information derived from the relative shave stroke direction information to the user through a graphical user interface provided by the computerized tool. In a further detailed embodiment, the computerized tool communicates shaving recommendation information derived from the relative shave stroke direction information to the user through the graphical user interface provided by the computerized tool.

Alternatively, or in addition, the sensor circuit segments at least some of the shave stroke direction information based upon one of a plurality of facial regions (such as cheek region(s), neck region(s), chin region(s) and/or lip region(s)) in which sensor signals were generated, and identifies facial regions associated with at least some of the shave stroke direction information; at least some of the hair growth direction information is segmented based upon the plurality of facial regions; and the notification circuit segments the relative shave stroke direction information based, at least in part, upon the facial regions identified in the shave stroke direction information.

In another aspect of the current disclosure, a method for transforming shaving appliance sensor information into a user notification includes the steps of: (a) providing a shaving appliance including a handle and a shaving head connected to the handle, and a plurality of sensors provided in one or more of the shaving head and handle; (b) receiving sensor signals from plurality of sensors; (c) generating shave stroke direction information from the received sensor signals; (d) determining relative shave stroke direction information for a user from the shave stroke direction information and from hair growth direction information electronically stored with respect to the user; and (e) providing a notification to the user based upon the relative shave stroke direction information. In a more detailed embodiment, the plurality of sensors include at least two of an accelerometer sensing acceleration in three dimensions of at least one of the shaving head and handle, a gyroscope sensing an angle of at least one of the shaving head and handle, a magnetometer sensing a relational position of at least one of the shaving head and handle, and a pressure sensor sensing pressure with respect to at least one of the shaving head and handle.

Alternatively, or in addition, the notification step occurs remote from the shaving appliance. Alternatively, or in addition, the notification step is performed by a computerized tool operating on a computerized device having access to a global computer network. Alternatively, or in addition, the method further includes a step of storing the hair growth direction information remotely from the handle and the shaving head. Alternatively, or in addition, the method further includes a step of collecting the hair growth direction information through a graphical user interface operating on a networked computer device wirelessly connected to a global computer network. Alternatively, or in addition, the method further includes a step of storing the hair growth direction information with user profile information for the user.

Alternatively, or in addition, the method further includes the steps of: (f) transmitting (i) the shave stroke direction information and/or (ii) the relative shave stroke direction information wirelessly to a global computer network; and (g) communicating (a) the relative shave stroke direction information and/or (b) information derived from the relative shave stroke direction information to the user through a graphical user interface provided by a computerized tool operating, at least in part, on a computerized user device connected to the global computer network. In a further detailed embodiment, the communicating step communicates shaving recommendation information derived from the relative shave stroke direction information to the user through the graphical user interface provided by the computerized tool.

Alternatively, or in addition, the method further includes a step of segmenting at least some of the shave stroke direction information according to a plurality of facial regions; the generating step identifies facial regions associated with at least some of the shave event information; and the notification step segments the relative shave stroke direction information based, at least in part, upon the facial regions identified in the shave stroke direction information.

BRIEF DESCRIPTION OF THE DRAWINGS

While the specification concludes with claims particularly pointing out and distinctly claiming the subject matter which is regarded as forming the current disclosure, it is believed that the invention will be better understood from the following description which is taken in conjunction with the accompanying drawings in which like designations are used to designate substantially identical elements, and in which:

DETAILED DESCRIPTION OF THE INVENTION

Figure 1:
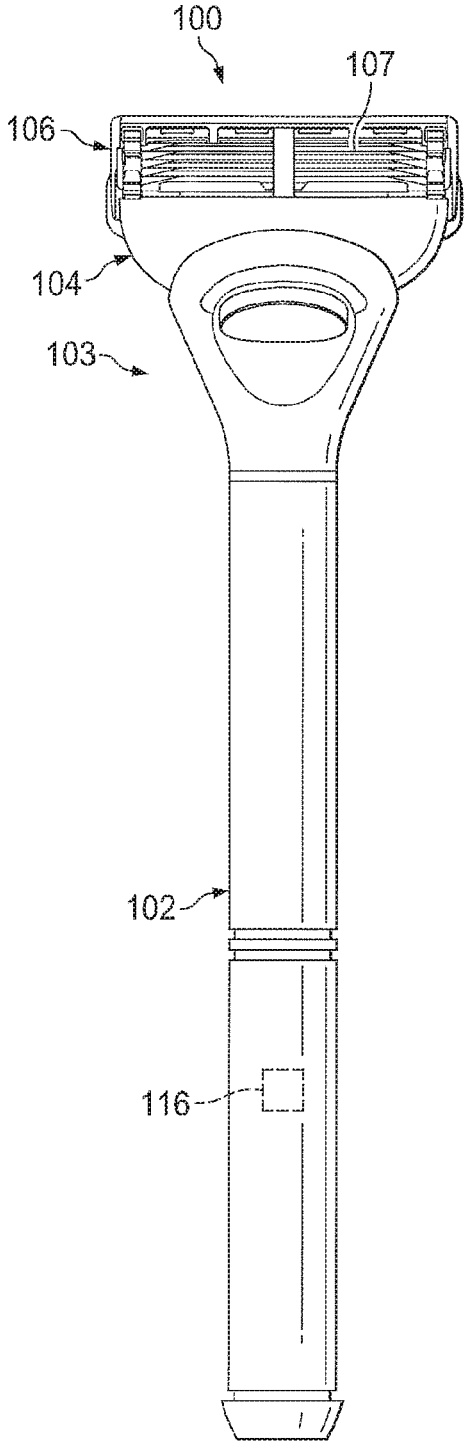
FIG. 1 is a view of a razor device including a handle according to an exemplary embodiment of the current disclosure.

A networked shaving appliance system includes: (a) a shaving appliance including a handle and a shaving head cartridge connected to the handle and motion, orientation, and/or pressure sensors associated with the handle and/or shaving head cartridge; (b) a sensor circuit connected to receive sensor signals and generate shave event information from the sensor signals; (c) a network circuit wirelessly connected with a computer network and communicating at least the shave event information to the computer network; and (d) a computerized tool operating, at least in part, on a computerized user device connected to the computer network. The computerized tool is configured to receive shave event data associated with a user of the computerized device from the computer network, receive user profile data from the user via a graphical user interface provided by the computerized tool, process the shave event data with the user profile data to generate user feedback information, and communicate the user feedback information to the user via the graphical user interface provided by the computerized tool.

Referring to FIGS. 1-4 there is shown a personal appliance 100. The personal appliance 100 shown is a shaving razor 103. The shaving razor 103 comprises a handle 102. The handle 102 comprises an implement connecting structure 105. An implement 104 is connected to the implement connecting structure 105. The implement 104 shown is a razor cartridge 106 (where the razor cartridge 106 may be, in certain embodiments, a removable and disposable razor cartridge). The razor cartridge 106 includes at least one blade 107 for cutting hair. The razor cartridge 106 shown includes five blades 107. Any number of blades 107 may be used for a razor cartridge design.

A razor cartridge displacement sensor 114 is positioned in the handle 102. The razor cartridge displacement sensor 114 measures a displacement of the razor cartridge 106 relative to a fixed position of the handle 102. A power source 118 is positioned in the handle 102. An acceleration sensor 110 is positioned in the handle 102. An angular velocity sensor 112 is positioned in the handle 102. A communication device 116 is positioned in the handle.

Figure 4:
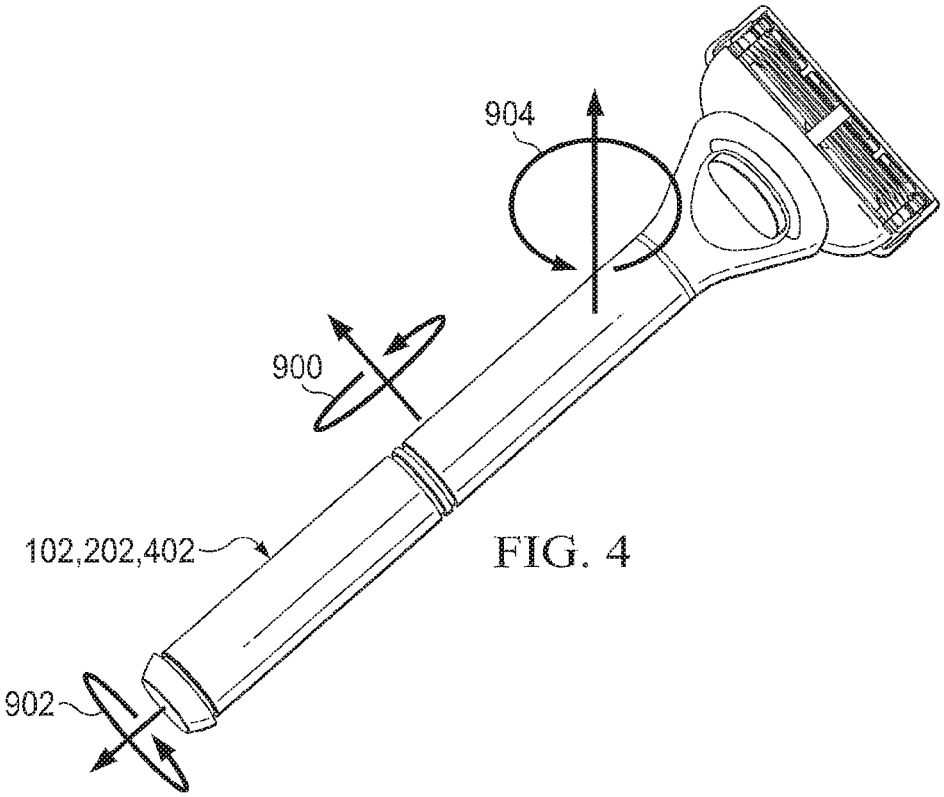
FIG. 4 is a perspective view showing the pitch, roll and yaw of a handle of a razor device according to the current disclosure.
Figure 5:
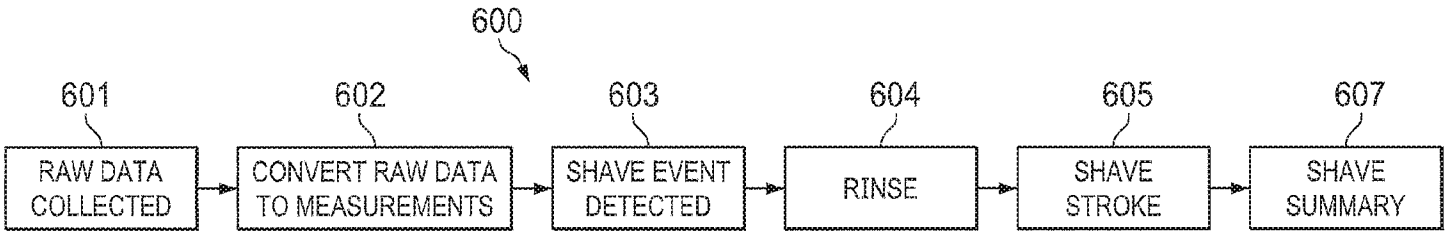
FIG. 5 is a plan diagram of the collected shave data and associated algorithms.

The acceleration sensor 110 preferably comprises an accelerometer 111. The accelerometer 111 measures the proper acceleration of the handle 102. The angular velocity sensor 112 preferably comprises a gyroscope 113. The gyroscope 113 measures the rotation or angular velocity of the handle 102. Together data from the acceleration sensor 110 and the angular velocity sensor 112 can be used to calculate the pitch and roll of the handle 102. Referring to FIG. 4, the pitch 900 and the roll 902 of the handle 102 are shown. The yaw 904 can also be calculated with data from the acceleration sensor 110 and the angular velocity sensor 112.

The razor cartridge displacement sensor 114 may take on many forms. Suitable razor cartridge displacement sensors 114 comprise a magnetometer, an optical sensor, a switch, a Hall Effect sensor, a capacitive sensor, a load sensor and a displacement sensor. The razor cartridge displacement sensor 114 is useful to detect and measure contact of the razor cartridge 106 with a user's body. Such contact measurement is an indication that the shaving razor 103 is in use as the razor cartridge 106 is in contact with the user's body.

The razor cartridge displacement sensor 114 comprises a magnet 160 embedded in follower 163 and a magnetometer 161 contained within handle 102. As the user shaves, razor cartridge 106 rotates or pivots as it contacts the user's skin. As the razor cartridge 106 rotates it pushes on follower 163 causing follower 163 to move inward into handle 102. As follower 163 moves inward into handle 102, magnet 160 moves closer to magnetometer 161. Follower 163 converts the rotational movement of the cartridge 106 into a linear displacement of the magnet 160 relative to handle 102. The amount of linear displacement of follower 163 directly correlates to the rotational displacement of razor cartridge 106 relative to a fixed position on handle 102. The razor cartridge displacement sensor 114 measures the change in magnetic field associated with the movement of magnet 160 relative to magnetometer 161.

While the razor cartridge displacement sensor 114 measures a linear displacement of magnet 160 relative to a fixed position on handle 102, razor cartridge displacement sensor 114 can also be used to determine a rotational displacement of razor cartridge 106 relative to a fixed position on handle 102.

Figure 3:
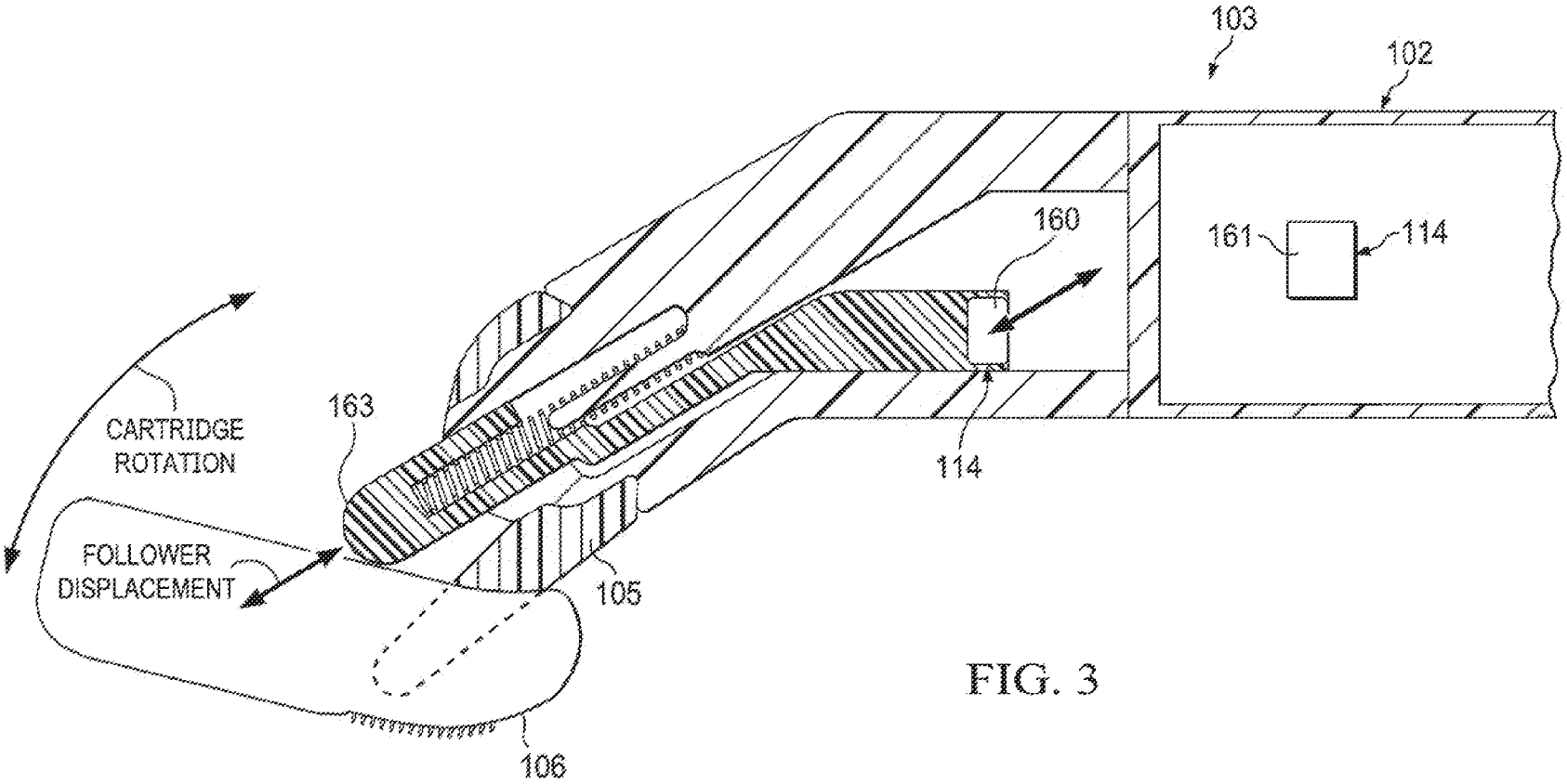
FIG. 3 is a cut away view of an exemplary razor device showing an exemplary displacement sensor.
Figure 3A:
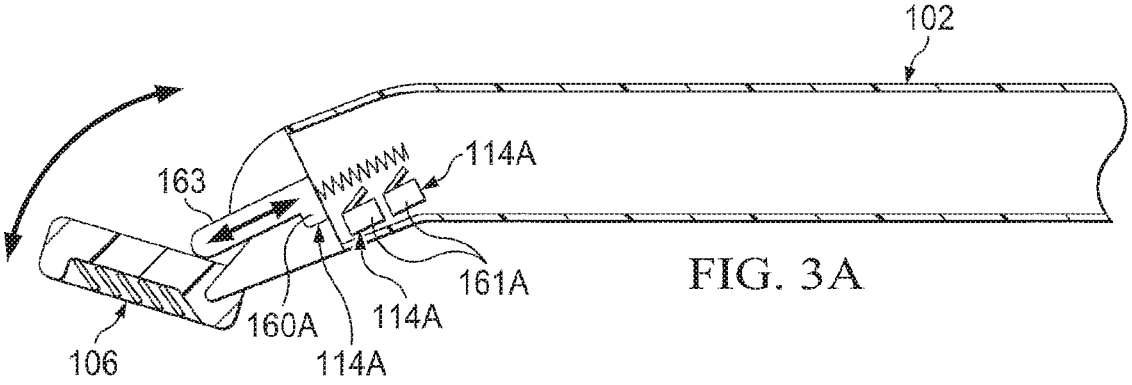
FIG. 3A is a cut away view of another exemplary razor device showing a different displacement sensor according to the current disclosure.

Referring now to FIG. 3A there is shown a cut away view of a personal appliance showing a displacement sensor 114A. The razor cartridge displacement sensor 114A comprises a mechanical feature 160A at the end of follower 163 and a series of switches 161A contained within handle 102. As the user shaves, razor cartridge 106 rotates or pivots as it contacts the user's skin. As the razor cartridge 106 rotates it pushes on follower 163 causing follower 163 to move inward into handle 102. As follower 163 moves inward into handle 102, mechanical feature 160A moves over switches 161A causing them to close in succession with the increase in inward movement of follower 163. Follower 163 converts the rotational movement of the cartridge 106 into a linear displacement of the mechanical feature 160A relative to handle 102. The amount of linear displacement of follower 163 directly correlates to the rotational displacement of razor cartridge 106 relative to a fixed position on handle 102. The razor cartridge displacement sensor 114A measures the change in linear distance associated with the movement of mechanical feature 160A relative to switches 161A.

While the razor cartridge displacement sensor 114A measures a linear displacement of mechanical feature 160A relative to a fixed position on handle 102, razor cartridge displacement sensor 114A can be used to determine a rotational displacement of razor cartridge 106 relative to a fixed position on handle 102.

Figure 3B:
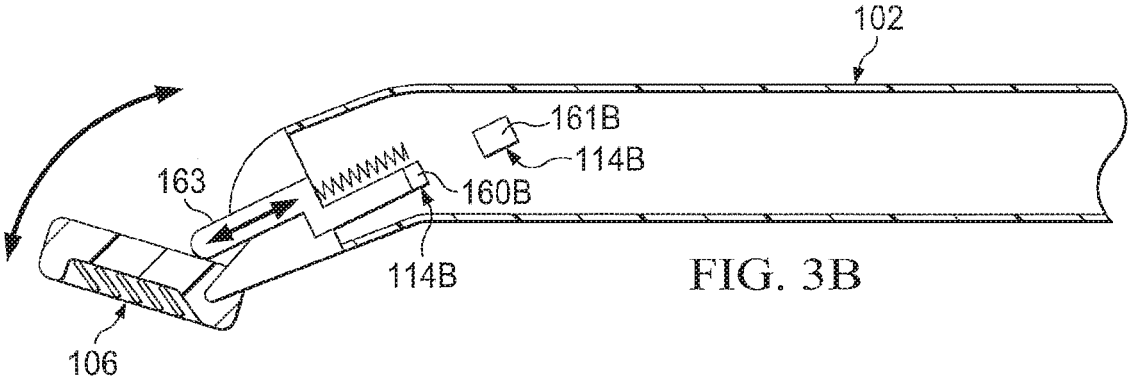
FIG. 3B is a cut away view of another exemplary razor device showing a different displacement sensor according to the current disclosure.

Referring now to FIG. 3B there is shown a cut away view of a personal appliance showing a displacement sensor 114B. The razor cartridge displacement sensor 114B comprises a magnet 160B at the end of follower 163 and a Hall Effect sensor 161B contained within handle 102. As the user shaves, razor cartridge 106 rotates or pivots as it contacts the user's skin. As the razor cartridge 106 rotates it pushes on follower 163 causing follower 163 to move inward into handle 102. As follower 163 moves inward into handle 102, magnet 160B moves closer to Hall Effect sensor 161B. Follower 163 converts the rotational movement of the cartridge 106 into a linear displacement of the magnet 160 relative to handle 102. The amount of linear displacement of follower 163 directly correlates to the rotational displacement of razor cartridge 106 relative to a fixed position on handle 102. The razor cartridge displacement sensor 114B measures the change in magnetic field associated with the movement of magnet 160B relative to Hall Effect sensor 161B.

While the razor cartridge displacement sensor 114B measures a linear displacement of magnet 160B relative to a fixed position on handle 102, razor cartridge displacement sensor 114B can also be used to determine a rotational displacement of razor cartridge 106 relative to a fixed position on handle 102.

Figure 3C:
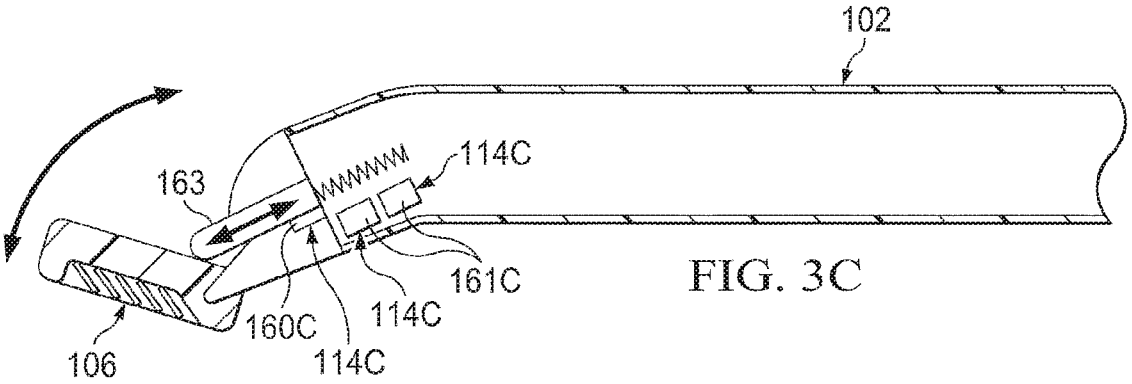
FIG. 3C is a cut away view of another exemplary razor device showing a different displacement sensor according to the current disclosure.

Referring now to FIG. 3C there is shown a cut away view of a personal appliance showing a displacement sensor 114C. The razor cartridge displacement sensor 114C comprises a material 160C that modifies the capacitive field at the end of follower 163 and a series of capacitive sensors 161C contained within handle 102. As the user shaves, razor cartridge 106 rotates or pivots as it contacts the user's skin. As the razor cartridge 106 rotates it pushes on follower 163 causing follower 163 to move inward into handle 102. As follower 163 moves inward into handle 102, material 160C moves over capacitive sensors 161C causing them to close in succession with the increase in inward movement of plunger 163. Follower 163 converts the rotational movement of the cartridge 106 into a linear displacement of the capacitively conductive material 160C relative to handle 102. The amount of linear displacement of follower 163 directly correlates to the rotational displacement of razor cartridge 106 relative to a fixed position on handle 102. The razor cartridge displacement sensor 114C measures the change in linear distance associated with the movement of material 160C relative to capacitive sensors 161C.

While the razor cartridge displacement sensor 114C measures a linear displacement of capacitively conductive material 160C relative to a fixed position on handle 102, razor cartridge displacement sensor 114C can be used to determine a rotational displacement of razor cartridge 106 relative to a fixed position on handle 102.

Figure 3D:
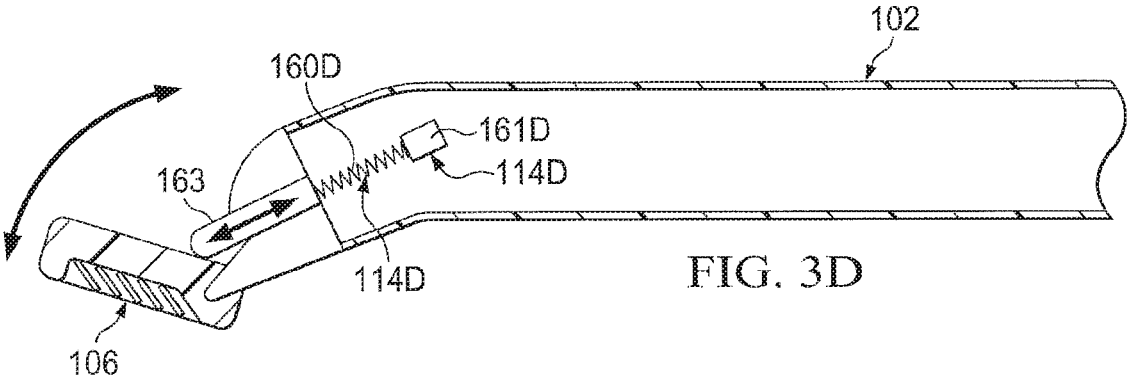
FIG. 3D is a cut away view of another exemplary razor device showing a different displacement sensor according to the current disclosure.

Referring now to FIG. 3D there is shown a cut away view of a personal appliance showing a displacement sensor 114D. The razor cartridge displacement sensor 114D comprises a spring 160D secured to the end of follower 163 and a load sensor 161D contained within handle 102. As the user shaves, razor cartridge 106 rotates or pivots as it contacts the user's skin. As the razor cartridge 106 rotates it pushes on follower 163 causing follower 163 to move inward into handle 102. As follower 163 moves inward into handle 102, the load on spring 160D is increased and detected by load sensor 161D. Follower 163 converts the rotational movement of the cartridge 106 into a load on spring 160D relative to handle 102. The amount of load on spring 160D 163 directly correlates to the rotational displacement of razor cartridge 106 relative to a fixed position on handle 102. The razor cartridge displacement sensor 114D measures the change in load associated with the load on spring 160D which is detected by load sensor 161D.

While the razor cartridge displacement sensor 114D measures a load on spring 160D and determines a linear displacement of cartridge 106 relative to a fixed position on handle 102, razor cartridge displacement sensor 114DB can also be used to determine a rotational displacement of razor cartridge 106 relative to a fixed position on handle 102 based on the measured load on load sensor 161D.

Figure 3E:
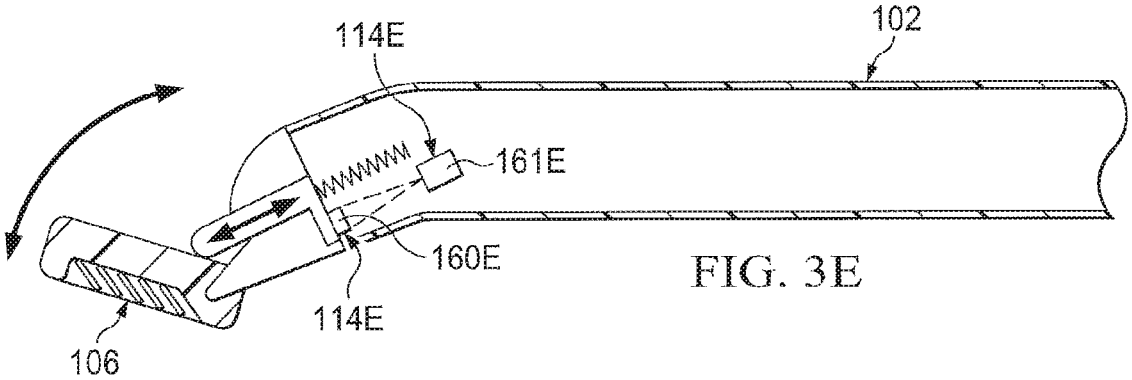
FIG. 3E is a cut away view of another exemplary razor device showing a different displacement sensor according to the current disclosure.

Referring now to FIG. 3E there is shown a cut away view of a personal appliance showing a displacement sensor 114E. The razor cartridge displacement sensor 114E comprises a visual marker 160E at the end of follower 163 and an optical sensor 161E contained within handle 102. As the user shaves, razor cartridge 106 rotates or pivots as it contacts the user's skin. As the razor cartridge 106 rotates it pushes on follower 163 causing follower 163 to move inward into handle 102. As follower 163 moves inward into handle 102, visual marker 161E moves closer to optical sensor 161E. Follower 163 converts the rotational movement of the cartridge 106 into a linear displacement of the visual marker 160E relative to handle 102. The amount of linear displacement of follower 163 directly correlates to the rotational displacement of razor cartridge 106 relative to a fixed position on handle 102. The cartridge displacement sensor 114E measures the change in linear distance associated with the movement of visual marker 160E which is detected by optical sensor 161E.

While the cartridge displacement sensor 114E measures a linear displacement of visual marker 160E relative to a fixed position on handle 102, cartridge displacement sensor 114E can be used to determine a rotational displacement of razor cartridge 106 relative to a fixed position on handle 102.

The communication device 116 may take on many forms. Suitable communication devices 116 comprise an LED display, an LCD display, a wired connection, a memory card which may be removable, a vibration device, a microphone, an audio device and/or a wireless connection such as, a Wi-Fi connection, a SIM card with GSM connection, a Bluetooth transmitter, a Li-Fi connection, and an infra-red transmitter. The communication device 116 allows the personal appliance 100 to communicate with a user and/or a second electronic device 180. The second electronic device 180 comprises a communication device 116A that can communicate with communication device 116. The communication with a second electronic device 180 may be wirelessly through a networked cloud architecture, through cellular networks, through Bluetooth connections and the like. The communication may be directly (wirelessly or wired) between the devices 116/116A, or through other networked or intermediate devices. The second electronic device 180 may a computerized device (such as the computerized device 1180 described below) such as smart-phone or computer (desktop, laptop, tablet, etc.), or may be a dedicated electronic device such as a base 301 for seating the razor 100. The communication device 116 may be mounted on the handle such that it is visible to the user. For example, the communication device 116 may comprise an LED display mounted on the handle to be visible to the user as shown in FIG. 1.

The power source 118 may take on many forms. Suitable power sources 118 comprise a rechargeable battery, a disposable battery and a corded electrical connection. The power source 118 powers the various sensors located in the handle 102 requiring power to operate. The power source may power the acceleration sensor 110, the angular velocity sensor 112, the cartridge displacement sensor 114 and/or the communication device 116.

Figure 1A:
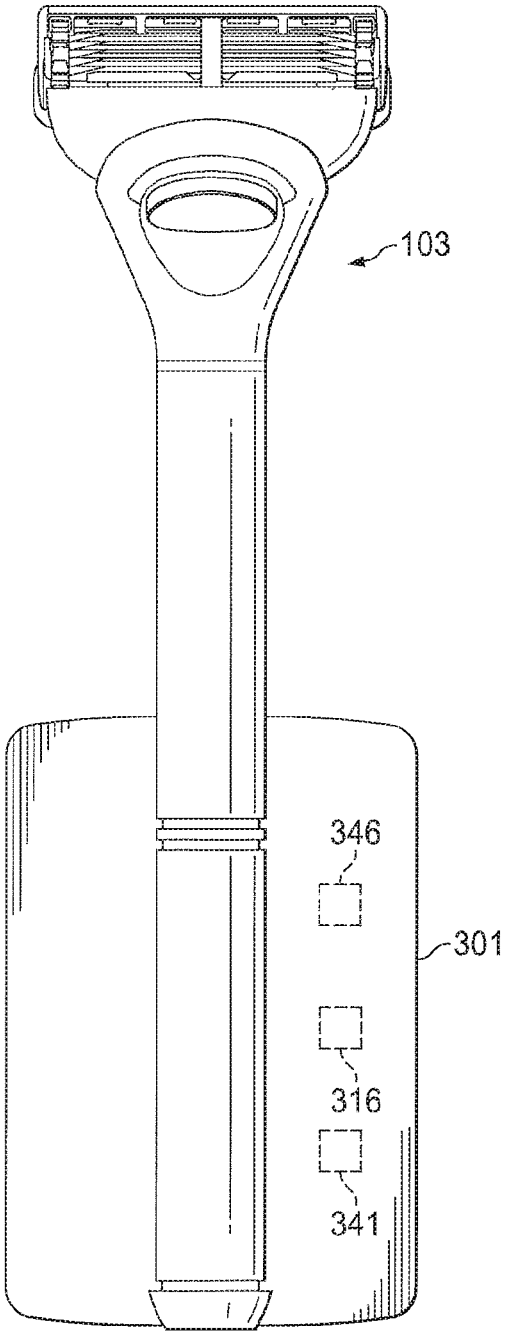
FIG. 1A is a view of the razor device of FIG. 1 along with an associated base according to an exemplary embodiment of the current disclosure.
Figure 2:
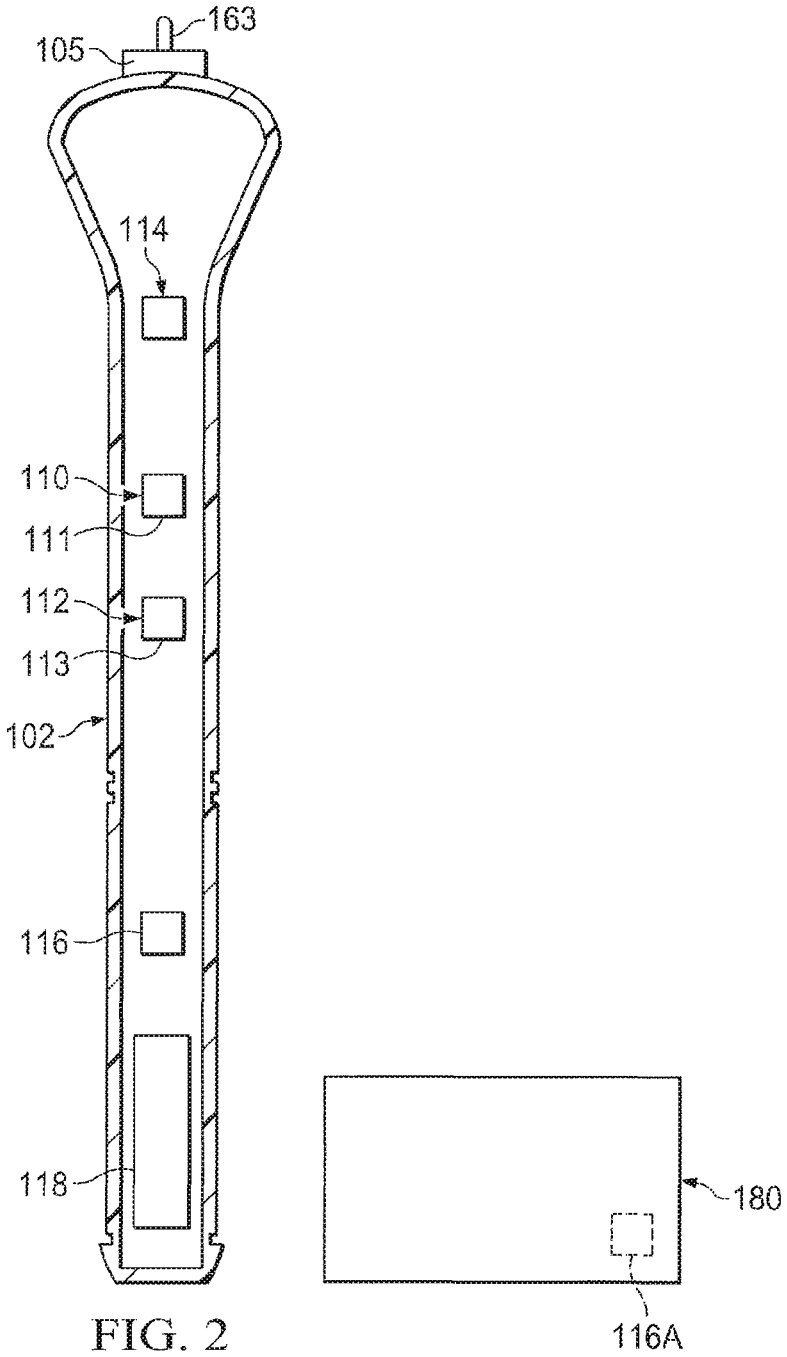
FIG. 2 is a cut away view of a handle for a razor device and a computerized device according to another embodiment of the current disclosure.

The shaving razor 103 may be held in base 301 when not in use as shown in FIG. 1A. Base 301 may serve as a charging station for a rechargeable power source in shaving razor 103. The base 301 comprises a communication device 316. The communication device 316 communicates with communication device 116 in shaving razor 103. Communication device 316 may be mounted in base 301 so that it is visible to the user to provide direct communication to the user. Communication device 316 may also communicate with a second device such as second electronic device 180 shown in FIG. 2. The base 301 may also comprise a memory storage device 341 and a microprocessor 346. The memory storage device 341 can store the collected data from shaving 103 where it can then be processed by microprocessor 346.

In use, the user will grasp handle 102 of shaving razor 103. The power source 118 will power up and power the sensors needing power. The power source 118 may power up automatically upon contact with or movement by user. Alternatively, the power source 118 may power up via an on/off switch. Alternatively, the power source 118 may be constantly on and preferably in a power save mode while not in use and then in full power mode when in use. The user will then shave with shaving razor 103.

As the user shaves, data is collected from the acceleration sensor 110, the angular velocity sensor 112, and the cartridge displacement sensor 114. The data collected can be used to calculate the pitch and roll of the handle 102 as well as contact data. The data collected may also be used to calculate pressure exerted on the razor cartridge 106, speed of movement of razor cartridge 106, the number and length of each shaving stroke experienced by razor cartridge 106, and the total distance or mileage the razor cartridge 106 has experienced at any given point in time. When the user is finished shaving the shaving razor 103 is put down and data collection stops. The collected data may be transmitted instantaneously as the data is collected via the communication device 116. Alternatively, the collected data is transmitted after the data from a single shaving event or multiple shaving events has been collected via the communication device 116. The data whether transmitted instantaneously or after a period of time can be transmitted through the communication device 116. The communication may be in the form of a color coming from an LED, such as yellow indicating that the pressure being exerted on the razor cartridge 106 is getting near a maximum pressure that is to be exerted on razor cartridge 106 and red indicating that the pressure being exerted on the razor cartridge 106 is exceeding the maximum pressure that is to be exerted on razor cartridge 106.

Referring now to FIGS. 5 and 1-4 there is shown a plan diagram 600 of the collected data and algorithms used with shaving razor 103. With the power source 118 on raw data is collected 601 during the shave event from acceleration sensor 110, angular velocity sensor 112 and cartridge displacement sensor 114. The raw data is then converted into measurements at 602. The measurements may be made by an electronic circuit device such as microprocessor. The microprocessor may be located within the handle. Alternatively, the raw data can be sent from communication device 116 to an external device such as a mobile phone, a computer application, a computer or electronic device. At 603 the shave event including the presence of a razor cartridge on the handle is detected from the raw data of the acceleration sensor 110, angular velocity sensor 112 and cartridge displacement sensor 114 using an algorithm. The algorithm may comprise of monitoring the displacement of the cartridge displacement sensor 114 while the razor is in a static condition to detect the presence of razor cartridge 106 connected to the handle 102 via the implement connecting structure 105. The displacement sensor will reset from a baseline position where no razor cartridge 106 is attached and the follower 163 is in a fully extended position to a first position where the displacement is in a new at rest position different from the baseline position as the follower is no longer in a fully extended position with the razor cartridge attached as the follower contacts the razor cartridge (this combination of signals may indicate, for example, a new razor cartridge 106 being attached to the razor handle 102). The algorithm may comprise of monitoring the activity strength as recorded by cartridge displacement sensor 114 or angular velocity sensor 112 or acceleration sensor 110. For example, if a user starts shaving there would be activation of the cartridge displacement sensor 114 when shaving razor 103 touches the skin on the user's face. With activation of the angular velocity sensor 112 or acceleration sensor 110 and no activation of the cartridge displacement sensor 114 the event could be rejected as a shave. The same logic can be used to determine if razor cartridge 106 has been ejected by looking for a signal on cartridge displacement sensor 114 (e.g., the displacement sensor 114 being returned to the baseline position as discussed above). Also, it can be understood that time between signals and events can be used to determine actions like re-application of shave cream.

At 604 a rinse of the razor cartridge 106 can be detected from the raw data of the acceleration sensor 110, angular velocity sensor 112, and cartridge displacement sensor 114 using an algorithm. A simple algorithm such as a decision tree (or ensemble of trees), logistic regression, or a recurrent neural network (RNN) can be trained by supervised learning to predict rinse versus no rinse using one or more of the sensor inputs. In some cases, like in RNN, raw sensor signals can be fed in to the train the model. In other case like decision trees features like mean, standard deviations, etc. can be calculated to feed into the trained model for prediction.

At 605 a shave stroke can be detected from the raw data of the cartridge displacement sensor 114, acceleration sensor 110, and angular velocity sensor 112 using an algorithm. An algorithm looking at activation of cartridge displacement sensor 114 in combination with a certain activity level of angular velocity sensor 112 or acceleration sensor 110 to indicate expected motion that represents a shave stroke.

At 607 a summary of the shave can be generated from a combination of 602, 603, 604, and 605. Block 607 can also be fused with other information directly from the consumer to add an extra level of context such as which strokes were made in the direction of the hair grain as will be described in further detail below. Information from either 602, 603, 604, or 605 and the user input providing information on what direction is their hair growing on a location of their face.

Figure 6:
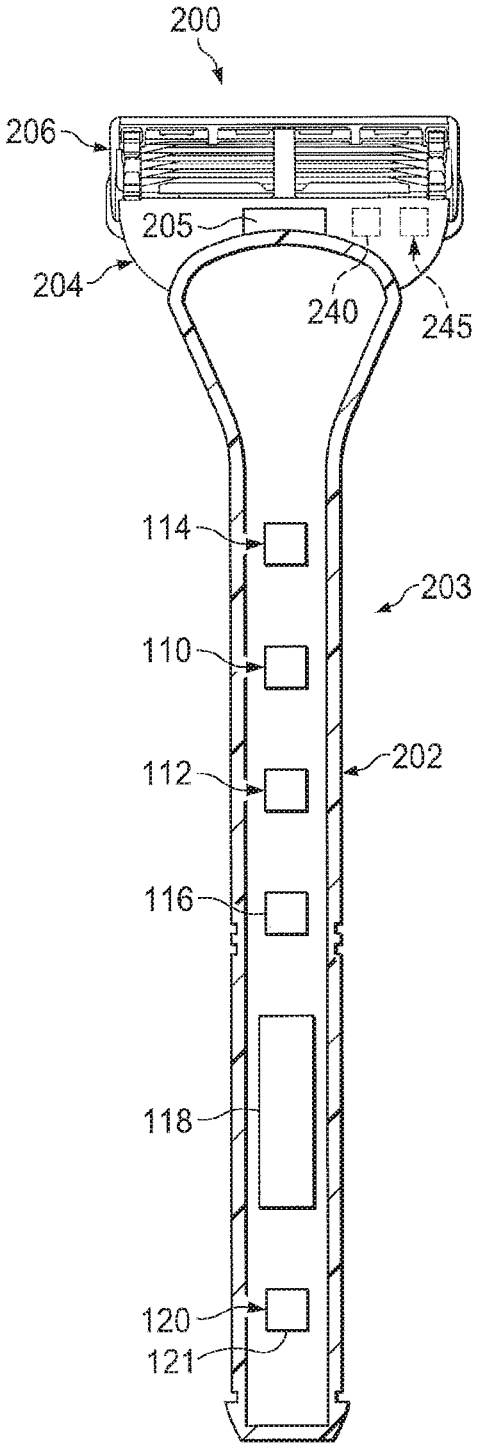
FIG. 6 is a cut away view of a handle for another exemplary shaving device according to the current disclosure.

Referring now to FIGS. 4 and 6, there is shown another exemplary appliance 200 embodied as a shaving razor 203. Shaving razor 203 includes implement 204, in this case razor cartridge 206 connected to implement connecting structure 205 of handle 202. Like the handle 102 shown in FIGS. 1 and 2, handle 202 comprises an acceleration sensor 110 positioned in the handle, an angular velocity sensor 112 positioned in the handle, an cartridge displacement sensor 114 positioned in the handle, a communication device 116 positioned in the handle, and a power source 118 positioned in the handle. Handle 202 also comprises a magnetic field sensor 120 positioned in the handle. The magnetic field sensor 120 measures the magnetic field to find the position of magnetic north and thus determine orientation of the handle 202. The magnetic field sensor 120 preferably comprises a magnetometer 121. The data from the magnetic field sensor 120, the acceleration sensor 110 and the angular velocity sensor 112 can be used to calculate the pitch, a roll and a yaw of the handle 200. Referring to FIG. 4 the pitch 900, the roll 902 and the yaw 904 of handle 202 are shown.

The shaving razor 230 may comprise one or more sensors 240 associated with the cartridge 206. The one or more sensors 240 associated with the cartridge 206 may comprise a switch, an acceleration sensor, a magnetic field sensor, an angular velocity sensor, a velocity sensor, a distance sensor, a proximity sensor, a displacement sensor, a capacitive sensor, an electrical conductance sensor, an electrical resistance sensor, an electrical current sensor, a load sensor, a strain sensor, a friction sensor, a fluid flow sensor, pressure sensor, an atmospheric pressure sensor, a temperature sensor, an optical sensor, an infrared sensor, an acoustic sensor, a vibration sensor, a humidity sensor, a chemical sensor, a particle detector, a bio sensor, an RFID sensor, a NFC sensor and/or a wireless receiver.

The method may further comprise a sensor 245 for detecting the presence of the cartridge 206 on the handle 202. As such, a change in sensing signals for sensor 245 from "no cartridge" to "cartridge present" may be indicative of (or used in producing) a "new-cartridge" event.

In use, the user will grasp handle 200 of shaving razor 203. The power source 118 will power up and power the sensors needing power. The power source 118 may power up automatically upon contact with or movement by user. Alternatively, the power source 118 may power up via an on/off switch. Alternatively, the power source 118 may be constantly on and preferably in a power save mode while not in use and then in full power mode when in use. The user will then shave with shaving razor 103. As the user shaves data is collected from the acceleration sensor 110, the angular velocity sensor 112, the cartridge displacement sensor 114 and the magnetic field sensor 120. The data collected may be used to calculate the pitch, roll and yaw data as well as contact data. When the user is finished shaving the shaving razor 203 is put down and data collection stops. The collected data may be transmitted instantaneously as the data is collected via the communication device 116. Alternatively, the collected data is transmitted after the data from a single shaving event or multiple shaving events has been collected via the communication device 116.

Figure 7:
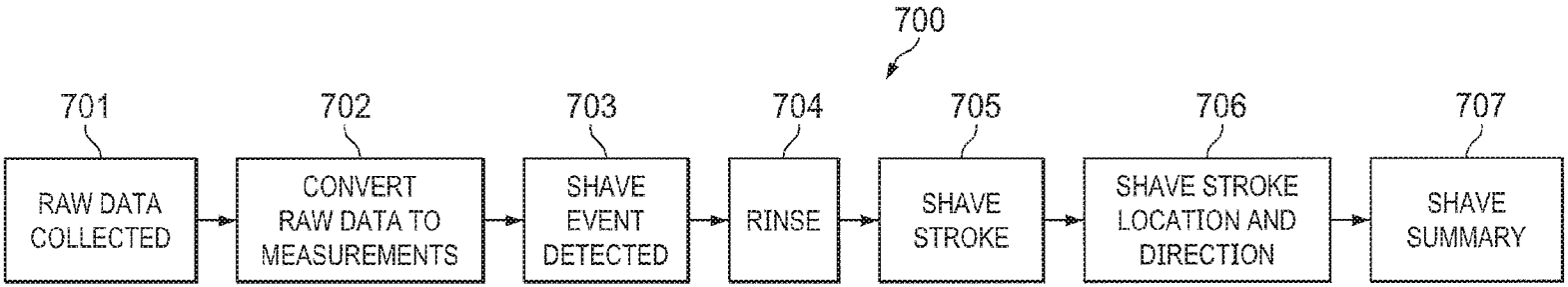
FIG. 7 is a plan diagram of collected shave data and associated algorithms.

Referring now to FIGS. 7 and 6 there is shown a plan diagram 700 of the collected data and algorithms used with handle 202 of shaving razor 203. With the power source 118 on raw data is collected 701 during the shave from acceleration sensor 110, angular velocity sensor 112, cartridge displacement sensor 114 and magnetic field sensor 120. The raw data is then converted into measurements at 702. The measurements may be made by a processing circuit, such as microprocessor. The microprocessor may be located within the handle, in the base station 301 or elsewhere. Alternatively, the raw data can be sent from communication device 116 to an external device such as a mobile phone, a computer application, a computer or electronic device. At 703 the shave event is detected from the raw data of the acceleration sensor 110, angular velocity sensor 112 and cartridge displacement sensor 114 using an algorithm. The algorithm may comprise of monitoring the activity strength as recorded by cartridge displacement sensor 114 or angular velocity sensor 112 or acceleration sensor 110. For example, if a user starts shaving there would be activation of the cartridge displacement sensor 114 when razor cartridge 206 touches the skin on the user's face. With activation of the angular velocity sensor 112 or acceleration sensor 110 and no activation of the cartridge displacement sensor 114 the event could be rejected as a shave. The same logic can be used to determine if razor cartridge 206 has been ejected by looking for a signal on cartridge displacement sensor 114. Also, it can be understood that time between signals and events can be used to determine actions like re-application of shave cream.

At 704 a rinse of the razor cartridge 206 can be detected from the raw data of the acceleration sensor 110, angular velocity sensor 112, and cartridge displacement sensor 114 using an algorithm. A simple algorithm such as a decision tree (or ensemble of trees), logistic regression, or a recurrent neural network (RNN) can be trained by supervised learning to predict rinse versus no rinse using one or more of the sensor inputs. In some cases, like in RNN, raw sensor signals can be fed in to the train the model. In other case like decision trees features like mean, standard deviations, etc. can be calculated to feed into the trained model for prediction.

At 705 a shave stroke can be detected from the raw data of the cartridge displacement sensor 114, acceleration sensor 110, and angular velocity sensor 112 and magnetic field sensor 120 using an algorithm. An algorithm looking at activation of cartridge displacement sensor 114 in combination with a certain activity level of angular velocity sensor 112 or acceleration sensor 110 to indicate expected motion that represents a shave stroke.

At 706 a shave stroke location (e.g., location on a facial region as described below) and direction can be detected from the raw data of the cartridge displacement sensor 114, acceleration sensor 110, angular velocity sensor 112 and magnetic field sensor 120 using an algorithm. An algorithm such as a decision tree (or ensemble of trees), logistic regression, or a recurrent neural network (RNN) can be trained by supervised learning to predict location on the user's face using one or more of the sensor inputs. In some cases, like in RNN, raw sensor signals can be fed in to train the model. In other case like decision trees features like mean, standard deviations, etc. can be calculated to feed into the trained model for prediction. One example algorithm for facial stroke location can be based upon the recognition of facial landmarks (such as sideburn areas, chin areas, and the like) based upon the movement and orientation of the razor in the area of the facial landmark, and then correlating the razor locations therebetween based upon the movements and the orientations of the razor around and between the identified facial landmark(s).

At 707 a summary of the shave can be generated from a combination of 702, 703, 704, 705 and 706. 707 can also be fused with other information directly from the consumer to add an extra level of context such as which strokes were made in the direction of the hair grain. Information from either 702, 703, 704, 705 or 706 and the user input providing information on what direction is their hair growing on a location of their face.

Figure 8:
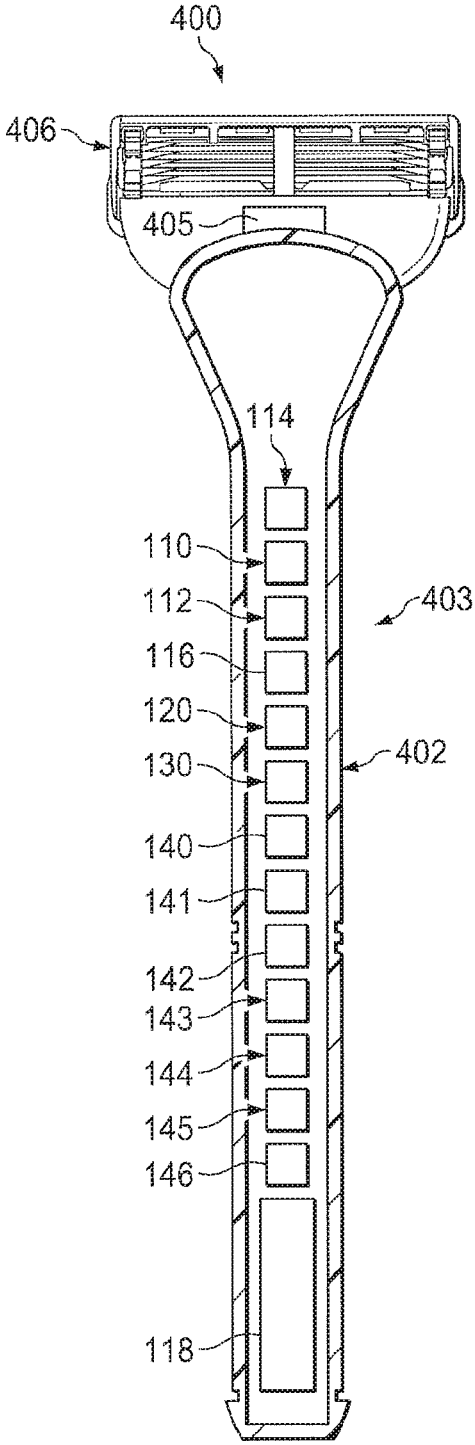
FIG. 8 is a cut away view of a handle for another exemplary shaving device according to the current disclosure.

Referring now to FIGS. 4 and 8, there is shown another personal appliance 400 embodied as a shaving razor 403. Shaving razor 403 comprises a handle 402. Shaving razor 403 includes razor cartridge 406 connected to implement connecting structure 405 of handle 402. Like the handle 202 shown in FIG. 6 handle 402 comprises an acceleration sensor 110 positioned in the handle; an angular velocity sensor 112 positioned in the handle; an cartridge displacement sensor 114 positioned in the handle; a communication device 116 positioned in the handle; a power source 118 positioned in the handle, and a magnetic field sensor 120 positioned in the handle.

Handle 402 also comprises one or more additional devices and sensors that may be used individually or in any combination. Additional devices and sensors comprise at least one orientation sensor 130, a clock 140, a memory storage device 141, an on/off switch 142, at least one temperature sensor 143, a barometric pressure sensor 144, a RFID sensor 145 and a microprocessor 146.

Suitable clocks 140 comprise a crystal oscillator, a ceramic oscillator and an RC oscillator. The clock 140 measures a length of time for an event whether it be a single stroke, a time between strokes, and a total shave time.

Suitable memory storage devices 141 comprise a non-volatile flash memory, a non-volatile flash memory card, a hard disk and/or a volatile DRAM.

The on/off switch 142 can be used to control power from the power source to any device and sensor needing power to operate. The on/off switch can control power from the power source to the acceleration sensor, the angular velocity sensor, the magnetic field sensor, the cartridge displacement sensor, the communication device and any other device and sensor. Suitable on/off switches comprise a mechanical switch, and electronic switch, a capacitive sensor, an accelerometer based trigger, a magnetic reed switch, an optical sensor, and an acoustic sensor.

Suitable temperature sensors 143 comprise a thermistor and a thermocouple. The temperature sensor can be used to measure the temperature of the handle and the head, such as a razor cartridge, attached to the head.

The additional devices and sensors can be used with the previously identified devices and sensors to collect data on a wide variety of attributes taking place during the shaving event. In use, the user will grasp handle 402 of shaving razor 403. The power source 118 will power up and power the sensors needing power. The power source 118 may power up automatically upon contact with or movement by the user. Alternatively, the power source 118 may power up via on/off switch 142. Alternatively, the power source 118 may be constantly on and preferably in a power save mode while not in use and then in full power mode when in use.

The user will then shave with shaving razor 403. The user will then shave with shaving razor 403. As the user shaves data is collected from the acceleration sensor 110, the angular velocity sensor 112, the cartridge displacement sensor 114, the magnetic field sensor 120, and the orientation sensor 130. If included data may also be collected from clock 140, at least one temperature sensor 143, barometric pressure sensor 144 and RFID sensor 145. The data collected may include pitch, roll, yaw, orientation, time data, temperature data, barometric pressure data, RFID data as well as contact data. When the user is finished shaving the shaving razor 403 is put down and data collection stops.

The collected data may be transmitted instantaneously as the data is collected via the communication device 116. Alternatively, the collected data may be stored in memory storage device 141. The collected data may be transmitted from memory storage device after the data from a single shaving event or multiple shaving events has been collected via the communication device 116.

Figure 9:
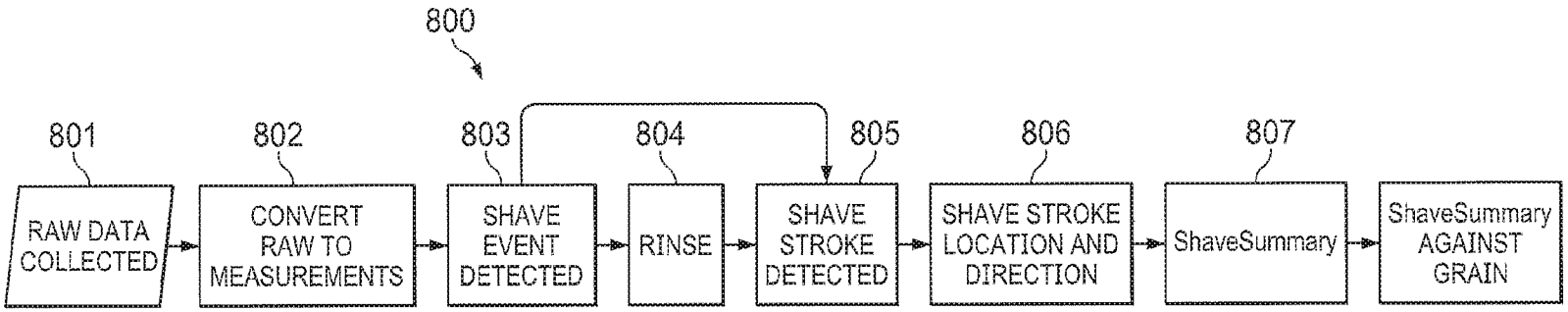
FIG. 9 is a plan diagram of collected shave data and associated algorithms.

Referring now to FIGS. 9 and 8 there is shown a plan diagram 800 of the collected data and algorithms used with handle 402 of shaving razor 403. After the handle 402 has been turned on via on/off switch 142, raw data is collected 801 during the shave from acceleration sensor 110, angular velocity sensor 112, cartridge displacement sensor 114, magnetic field sensor 120, orientation sensor 130, clock 140, temperature sensor 143, barometric pressure sensor 144 and RFID sensor 145. The raw data is stored in memory storage device 141. The raw data is then converted into measurements at 802. The measurements may be made by a logistics device such as microprocessor 146. Alternatively, the raw data can be sent from communication device 116 to an external device such as a mobile phone, a computer application, a computer or electronic device.

At 803 the shave event is detected from the raw data of the acceleration sensor 110, angular velocity sensor 112 and cartridge displacement sensor 114, and/or barometric pressure sensor 144 using an algorithm. The algorithm may comprise of monitoring a pressure reduction from barometric pressure sensor 144 in combination with activity strength as recorded by cartridge displacement sensor 114 or angular velocity sensor 112 or acceleration sensor 110. For example, if a user starts shaving there would be a drop in pressure value as detected by barometric pressure sensor 144 indicating that the user moved shaving razor 403 from a starting surface to the user's face and there would be activation of the cartridge displacement sensor 114 when shaving razor 403 touches the skin on the user's face. With activation of barometric sensor 144 without activation of cartridge displacement sensor 114 the event would be rejected as a shave. The same logic can be used to determine if razor cartridge 406 has been ejected by looking for a signal on cartridge displacement sensor 114. Also, it can be understood that time between signals and events can be used to determine actions like re-application of shave cream.

At 804 a rinse of the razor cartridge 406 can be detected from the raw data of the acceleration sensor 110, angular velocity sensor 112, cartridge displacement sensor 114, and/or the barometric pressure sensor 144 using an algorithm. A simple algorithm such as a decision tree (or ensemble of trees), logistic regression, or a recurrent neural network (RNN) can be trained by supervised learning to predict rinse versus no rinse using one or more of the sensor inputs. In some cases, like in RNN, raw sensor signals can be fed in to the train the model. In other case like decision trees features like mean, standard deviations, etc. can be calculated to feed into the trained model for prediction.

At 805 a shave stroke can be detected from the raw data of the cartridge displacement sensor 114, acceleration sensor 110, angular velocity sensor 112, magnetic field sensor 120 and orientation sensor 130 using an algorithm. An algorithm looking at activation of cartridge displacement sensor 114 in combination with a certain activity level of angular velocity sensor 112 or acceleration sensor 110 to indicate expected motion that represents a shave stroke.

At 806 a shave stroke location and direction can be detected from the raw data of the cartridge displacement sensor 114, acceleration sensor 110, angular velocity sensor 112, magnetic field sensor 120 and orientation sensor 130 using an algorithm. An algorithm such as a decision tree (or ensemble of trees), logistic regression, or a recurrent neural network (RNN) can be trained by supervised learning to predict location on the user's face using one or more of the sensor inputs. In some cases, like in RNN, raw sensor signals can be fed in to train the model. In other case like decision trees features like mean, standard deviations, etc. can be calculated to feed into the trained model for prediction.

At 807 a summary of the shave can be generated from a combination of 802, 803, 804, 805, 806. 807 can also be fused with other information directly from the consumer to add an extra level of context such as which strokes were made in the direction of the hair grain. To do this, we would need information form either 802, 803, 804, 805, or 806 and the user input telling us what direction is their hair growing on a location of their face.

Figure 10:
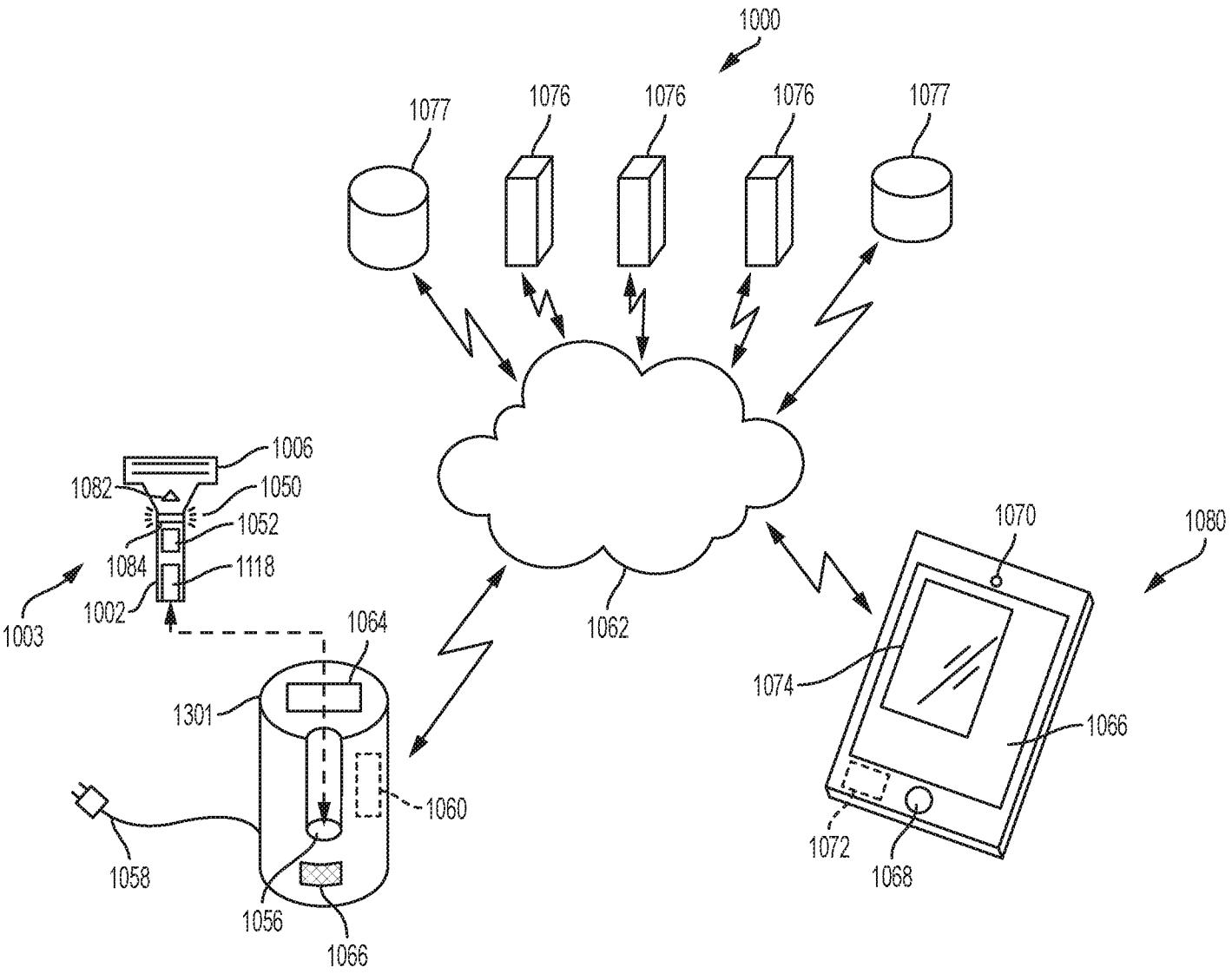
FIG. 10 is a block diagram view of the networked system in accordance with the current disclosure.

FIG. 10 discloses a networked shaving appliance system 1000 according to the current disclosure. The networked shaving appliance system includes a shaving appliance 1003 which may be any of the razor appliances disclosed herein such as razor 103, razor 203, razor 403 and/or any similar or modified razor according to and/or supported by the current disclosure. The razor appliance 1003 includes a removable razor cartridge 1006, a razor handle 1002, an internal power source 1118 and an optional multi-color LED display 1050.

As discussed above and herein, the razor appliance 1003 may include a plurality of internal sensors such as motion sensor(s), orientation sensor(s), cartridge ejection sensor(s), new cartridge detection sensors, and/or pressure sensor(s) associated with the handle 1002 and/or razor cartridge 1006. The shaving appliance 1003 may also include an appliance circuit 1052 connected to receive (via a data connection) sensor signals from the plurality of sensors contained within the razor appliance 1003. In the current embodiment, the network shaving appliance system 1000 also includes a base station 1301, where the base station includes a seat 1056 for receiving and engaging with the handle 1002 of the razor appliance 1003. In the current embodiment, the base station 1301 may be powered by electricity via an electric cord 1058 that may be plugged into a standard electrical outlet. The seat 1056 may include electrodes (not shown) that are adapted to engage with and/or mate with corresponding electrodes (again not shown) on the razor appliance handle 1002. Through such electrodes the base station 1301 may provide power to charge the power source (such as a rechargeable battery) 1118 in the razor appliance 1003 and/or may provide an electrical connection for the transfer of data signals from the sensor circuit 1052 within the razor handle 1002 to a base station circuit 1060 residing within the base station 1301. It is also within the scope of the current disclosure that power may be provided from the base station 1052 to the razor's power source 1118 by a non-connected capacitive coupling as known in the art, or any other wireless mechanisms that are known for wirelessly/contactless transferring power from a first power source to a rechargeable power source. It is also within the scope of the current disclosure that the power source 1118 may be removable, such as disposable batteries and/or rechargeable batteries that are charged by something other than the base station 1301. Further, it is within the scope of the current disclosure that data transmitted/received between the razor 1003 and the base station 1301 may be via wireless data connection, such as a Bluetooth connection and the like. It is also within the scope of the current disclosure that some or all of the mechanisms, circuitry and/or functionality of the base station 1301 as described herein can reside within razor 1003.

In the current embodiment, the base station 1301 includes base station circuitry 1060 that includes processor(s) and corresponding circuitry for receiving the sensor signals (and/or information derived from the sensor signals) and converting the sensor signals/information into associated shave event information as described herein. The base station circuitry 1060, in the current embodiment, also includes a network circuitry for a wireless data communication (e.g., such as a cellular and/or WiFi connection) with a computer network 1062 such as a cellular network and/or an internet network. The base station 1301 may also include a visual display 1064, such as an LCD display and/or a similar text or image display device as known to those of ordinary skill, where such display device 1064 may be controlled by the base station circuitry 1060. The base station 1301 may also include a sound actuator 1066 also controlled by the base station circuitry 1060, where the sound actuator 1066 may include a speaker or similar sound-making component.

Figure 11:
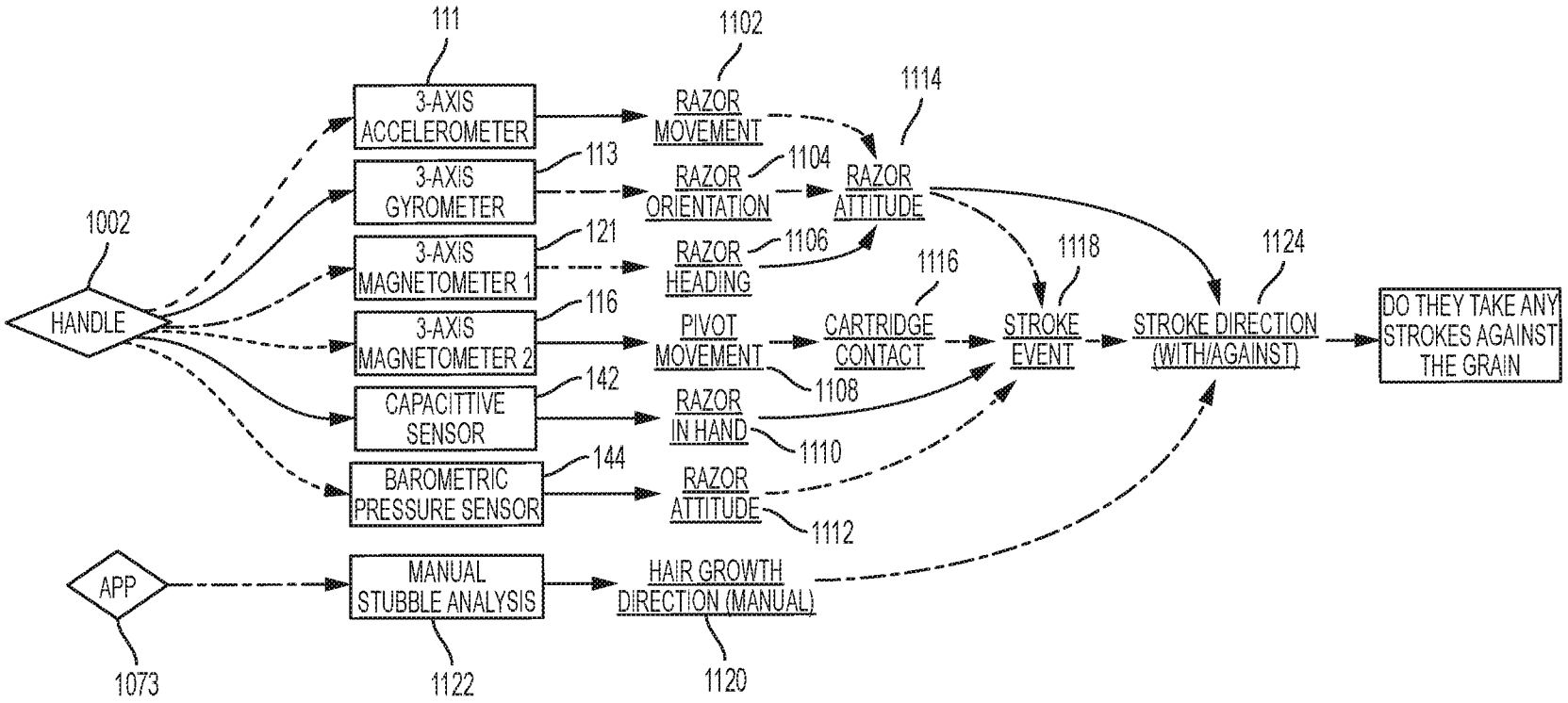
FIG. 11 is a flow diagram showing exemplary conversion of sensor data and user-provided information to shave event and other related information according to an embodiment of the current disclosure.

As further shown in FIG. 11, the networked shaving appliance system 1000 also includes a computerized and networked user interface device 1080. The computerized and networked user interface device 1080 can be in the form of a smart phone, a tablet computer, a laptop or desktop computer, a computerized wearable appliance such as a smart watch or smart glasses, and the like. The computerized and networked user interface device 1080 may include a display 1066, and a user input device such as a cursor control device 1068 (or a touch screen or a voice activated control, or a motion sensor, or an eye movement sensor and the like as are readily available to the art), a camera 1070 and associated processing circuitry 1072. The computerized and networked user interface device 1080 may operate to perform various software applications such as a computerized tool which may be in the form of a personal shaving application 1073 as will be discussed in further detail herein. As further described herein, the personal shaving application 1073 may include a graphical user interface 1074, which may be displayed on the display screen 1066 and controlled and/or receive user input therein from the user input devices such as the cursor-controlled device 1068 and/or the touch screen. The user device circuitry 1072 may include a network circuit for connecting wirelessly with the computer network 1062 for the purpose of receiving and/or transmitting data over the computer network 1062.

As also illustrated in FIG. 10, the computer network 1062 may have various computer servers and/or distributed computing devices (collectively labeled as 1076) also accessible thereto and may additionally include various data storage devices 1077 operatively coupled by a data connection thereto. For example, the software application 1073 may include operations being performed on one or more of the computer servers/devices 1076 and/or on the device circuitry 1072. Likewise, data storage associated with the software application 1073 may be within one or more of the data storage devices 1077 and/or on the device circuitry 1072.

At a very high level, one or more of the appliance circuit 1052, base station circuit 1060, user device circuitry 1072 and/or processors associated with the distributed computing environment 1076 comprise a sensor circuit for receiving the sensor signals from the razor appliance 1003 and for generating shave event information from the sensor signals as described herein. This shave event information will also be communicated over the computer network 1062 so that a computerized tool which may be in the form of the software application 1073 operating on the networked user interface device 1080 may receive the shave event data (or at least portions thereof) associated with a user of the computerized device 1080 from the network 1062. The computerized tool in the form of the software application 1073 may also be configured to receive user profile data information from the user via the graphical user interface 1074 provided by the software application 1073. Further, the software tool 1073 may process the shave event data received from the computer network 1062 with the user profile data provided by the user through the software application 1073 to generate user feedback information associated with the user's shaving experience as described herein; and then finally, communicate that user feedback information to the user via the graphical user interface 1074 provided by the computerized tool 1073 as also described herein.

As shown in FIG. 11, examples of measurement information or shave event information include razor movement information 1102 based upon acceleration in X, Y and Z directions derived from sensor data received form the 3-axis accelerometer 111 as described above; razor orientation information 1104 based upon angle information derived from sensor signals received from the 3-axis gyrometer 113 as described above; razor heading information 1106 based upon relationship with magnetic north derived from sensor signals received from the 3-axis magnetometer 121 as described above; cartridge pivot movement information 1108 (also cartridge presence, cartridge contact and/or trimmer contact) based upon relationship of a magnet with respect to a pivot plunger derived from sensor signals received from the 3-axis magnetometer 116 as described above; razor-in-hand information (information corresponding to a user gripping the handle 1002) 1110 based upon barometric pressure derived from sensor signals received from the capacitive sensor 142 as described above; and razor attitude information 1112 derived from sensor signals received from the barometric pressure sensor 144 as described above.

As also shown in FIG. 11, razor attitude information 1114 can be derived from a combination of the razor movement information 1102, razor orientation information 1104 and razor heading information 1106. Cartridge contact information 1116 can be derived from pivot movement information 1108. Stroke event information can be derived from a combination of the razor attitude information 1114, razor contact information 1116, razor-in-hand information 1110 and razor attitude information 1112.

As further shown in FIG. 11, the measurement and shave event information may also include information provided by the user through the software application 1073. For example, as will be described in further detail below, hair growth direction information 1120 may be provided by the user through the software application 1073 through a manual stubble analysis 1122 performed by the user. Consequently, relative stroke direction information 1124 (which determines whether or not the stroke directions are with or against the direction of hair growth on the user's face) can be derived from a combination of razor attitude information 1114, stroke event information 1118 and the hair growth direction information 1120 provided by the user. Similarly, over-stroke information or over-strokes with/against the grain can be determined based upon a combination of sensor readings taken from a plurality of the same sensors and user provided information as used for shave direction information and/or relative shave direction information.

Additional sensors, as discussed herein, may include thermistors for sensing handle operating temperature and/or in-handle temperature; capacitive sensors for sensing razor-in-hand; multi-capacitance sensors for sensing grip positions; clocks for sensing time; acoustic sensors for sensing shave performance (such as with or against grain) and the like.

Another aspect to the current disclosure is that the shave event information can be cumulative shave event information starting at a time with the system senses or is informed that a new shaving cartridge 1006 is attached to the razor 1003. As discussed above, this new cartridge determination can be sensed by the displacement sensor 114 based upon a combination of displacement sensor positions (such as a first position indicating that a razor cartridge has been ejected followed by a second position indicating that a new cartridge has been attached and/or used, or upon a significant change in displacement sensor 114 readings over a short period of time indicating an eject or insertion event). Similar new cartridge determination information may be provided by receiving sensor signals associated with the cartridge eject button 1082 on the razor appliance 1003 followed by sensor information associated with the displacement sensor 114 (indicating movement or other activity associated with a new cartridge attached to the handle). Similarly, new cartridge determination information may be provided by having a new-cartridge sensor becoming active upon the cartridge ejections occurring (such as a mechanical switch being set for activation when a cartridge is ejected), where the new-cartridge sensor may be then actuated when the new cartridge is inserted. New cartridge information may also be manually indicated by the user such as through the software application 1073 or by the user pressing a reset button (or the like), for example, on the base station 1301. Additionally, new cartridge information may be detected by the razor appliance 1003 by detecting a unique I.D. for each razor cartridge that is attached to the handle 1002. For example, a unique I.D. can be a barcode on the cartridge sensed by an associated barcode reader on the handle; can be an RFID tag on the cartridge sensed by an associated RFID reader on the handle; can be an I.D. on the cartridge communicated to the handle by magnetic, electric or capacitive data communication; can be a physical I.D. such as a physical key on the cartridge 1006 that is sensed by the handle 1002; and so forth. Essentially, any known manner for the appliance 1003 or system 1000 to detect or be notified when a new razor cartridge 1006 is coupled to the handle 1002 (the new cartridge event) will begin the collection point for cumulative shave event data where that cumulative shave event data will be thereafter associated with the age of the new razor cartridge 1006. This cumulative shave event information can be used to calculate or estimate, for example, the sharpness of the associated blades contained within the cartridge 1006.

Figure 12:
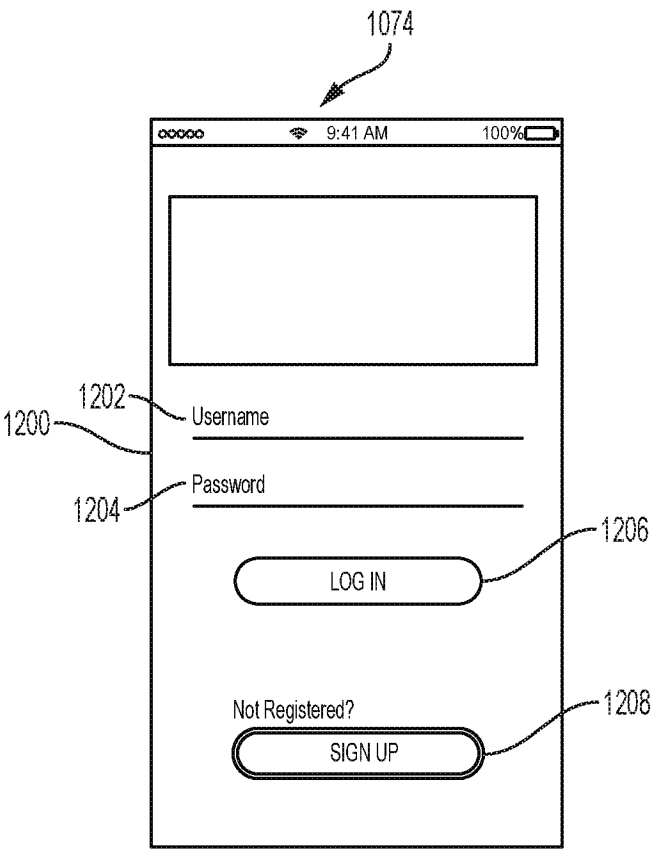
FIG. 12 is an exemplary graphical user interface screen of a software application according to an embodiment of the current disclosure.

FIGS. 12 through 18 provide example illustrations of the graphical user interface display 1074 of an example software application 1073 running on the computerized and networked user interface device 1080. FIG. 12 is an example of a typical user login screen 1200 for access to the software application 1074. As typically present with such login screens 1200, the user will be provided the ability to enter a user name 1202 and a password 1204, thereafter hitting the login button 1206. And the user will also be provided with the appropriate screens for signing up as a new user by hitting the sign-up button 1208 if not already registered.

Figure 13:
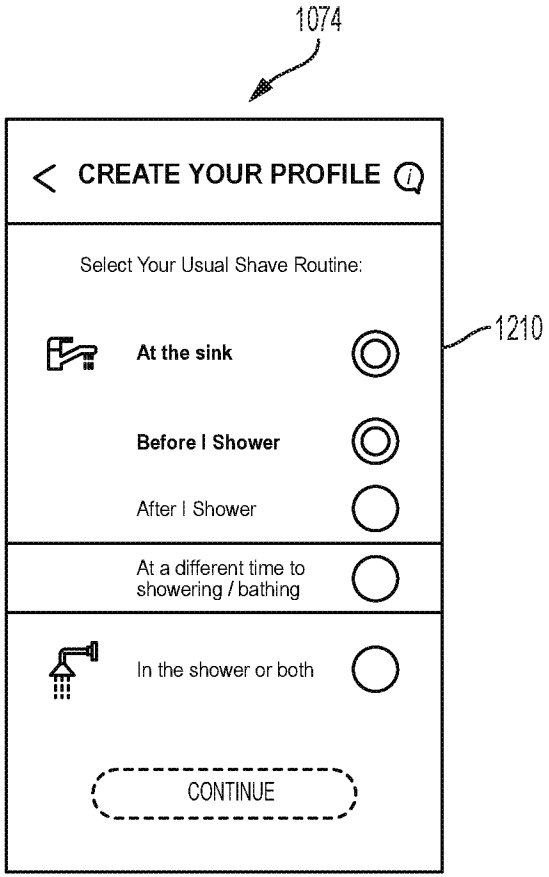
FIG. 13 is an exemplary graphical user interface screen of a software application according to an embodiment of the current disclosure.

When the user first registers with the software application 1074, the application may take the user through a series of steps so that the user can set up and create a profile for storage by the device circuitry 1072 and/or by networked storage device(s) 1077. FIG. 13 is an example of such a page 1210 for creating part of the user's profile. In screen 1210, the user is asked to select when and where the user will typically shave such as "at the sink", "before showering", "after showering", "at a different time to showering/bathing", and/or "in the shower or both".

Figure 14:
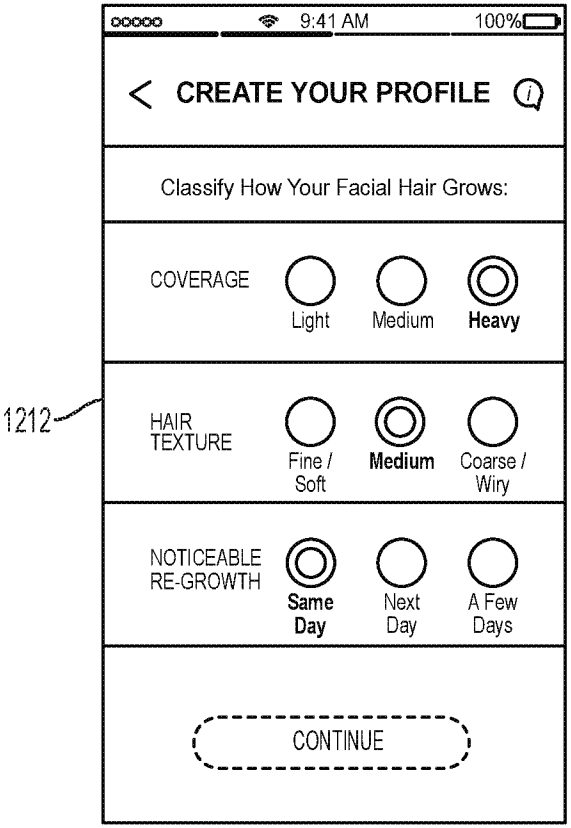
FIG. 14 is an exemplary graphical user interface screen of a software application according to an embodiment of the current disclosure.

FIG. 14 provides an example screen 1212 for further creation of the user's profile such as classifying how the user's facial hair grows. For example, with respect to facial hair coverage the user can select whether or not the "coverage" is "light," "medium" or "heavy;" with respect to facial "hair texture" the user can select whether it is "fine/soft," "medium" or "coarse/wiry," and with respect to "noticeable hair re-growth" the user can select "same-day," "next-day" or "a few days."

Figure 15:
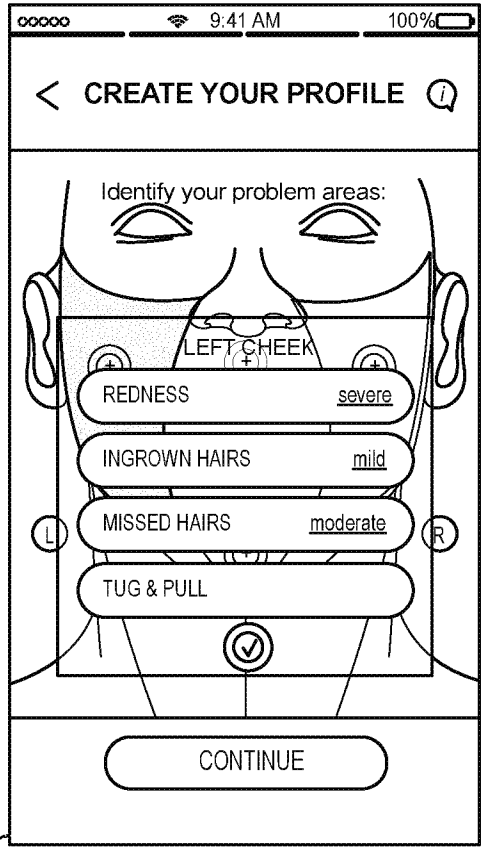
FIG. 15 is an exemplary graphical user interface screen of a software application according to an embodiment of the current disclosure.

Continuing, FIG. 15 provides another example screen 1214 in which the user can further create his or her user profile. In this screen, the user is provided the ability to identify problem areas with respect to shaving. For example, the user is asked to indicate whether "redness" is a shaving problem and whether or not that shaving problem is "severe," "mild" or "moderate." Additionally, in the same manner, the user can identify whether "ingrown hairs" is a shaving problem, "missed hairs" is a shaving problem and/or "tag & pull" is a shaving problem.

Figure 16:
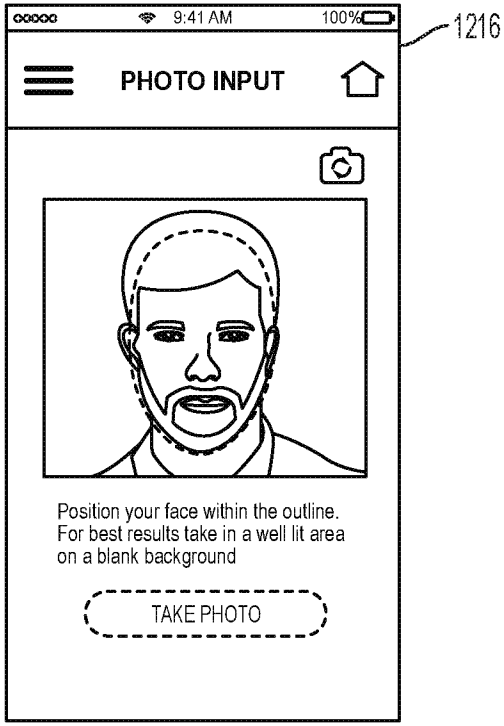
FIG. 16 is an exemplary graphical user interface screen of a software application according to an embodiment of the current disclosure.

Continuing on to FIG. 16, as part of generating the user's profile, the application 1073 can provide a screen 1216 and associated algorithms that allow the computerized and networked user interface device 1080 to use that device's camera 1070 (if it has one) to take a photo or "selfie" of the user's face and where the associated programming algorithms within the application software 1074 can determine hair growth position and type information based upon the photo taken and input into the user's profile.

Figure 18:
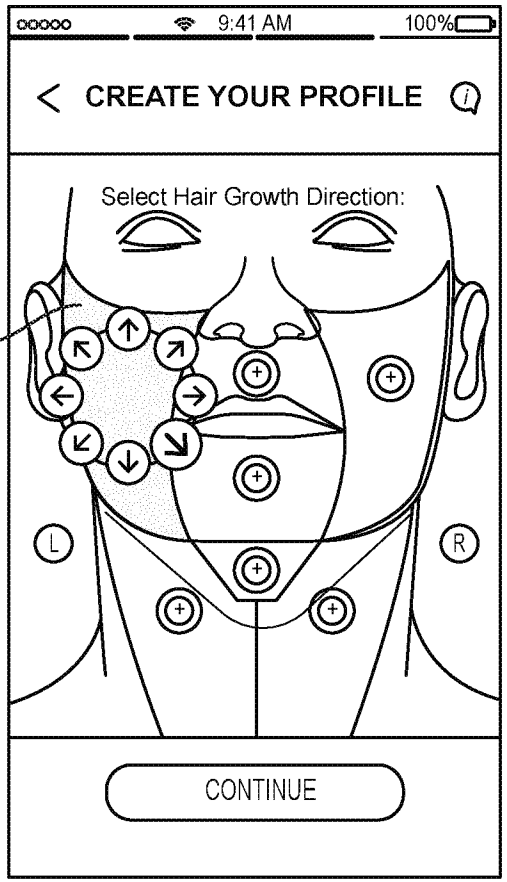
FIG. 18 is an exemplary graphical user interface screen of a software application according to an embodiment of the current disclosure.
Figure 17:
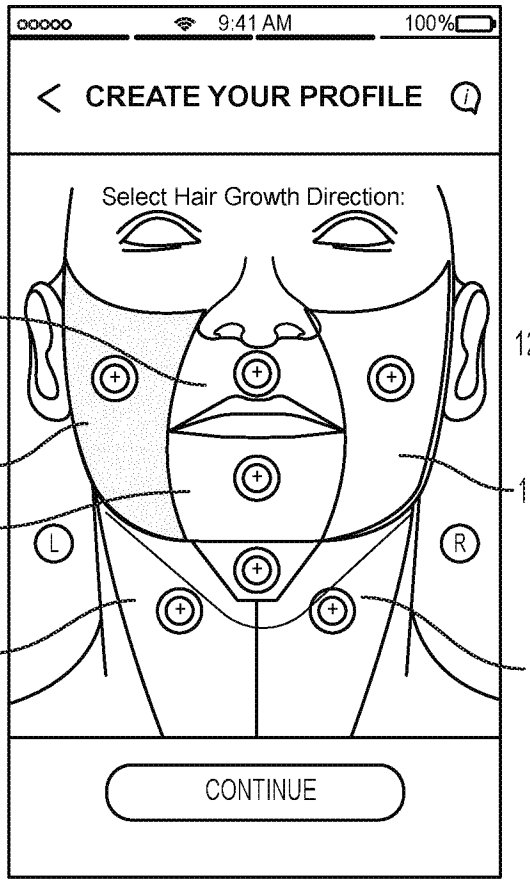
FIG. 17 is an exemplary graphical user interface screen of a software application according to an embodiment of the current disclosure.
Figure 19:
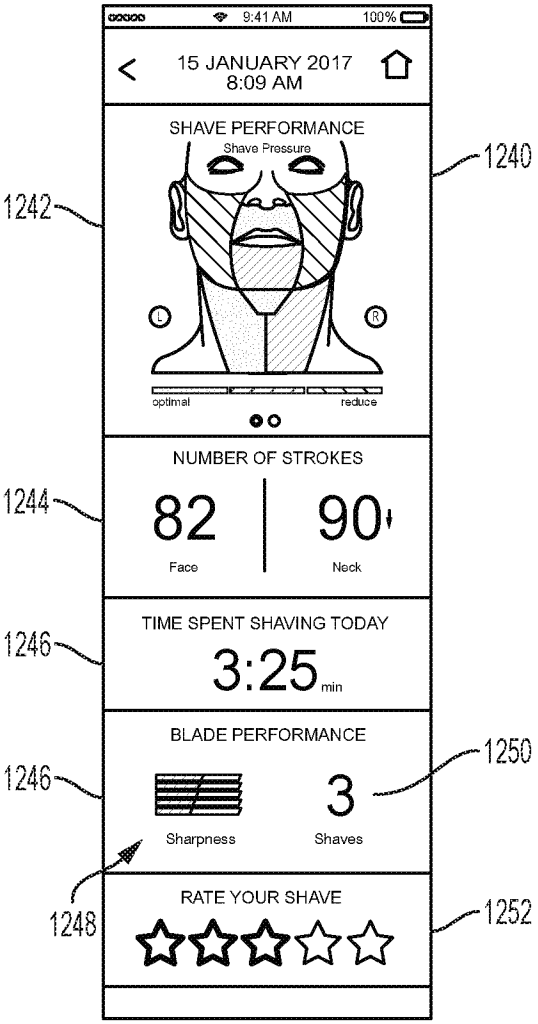
FIG. 19 is an exemplary graphical user interface screen of a software application according to an embodiment of the current disclosure.

As shown in FIGS. 17 and 18, the user is provided the ability to provide hair growth information depending upon a specific region of the user's face. For example, the profile information entered by the user can be segmented into left and right cheek regions 1220, left and right neck regions 1222, a chin region 1224 and/or an upper lip region 1226. The example profile screen at FIGS. 18 and 19 allows the user to select one of these facial regions and provide hair growth direction information associated therewith. For example, as shown in FIG. 19, the user has selected the left cheek region 1220L, and upon selection of that region the screen provides a series of directional areas in which the user can select the directional arrow most closely representing the hair growth direction for that region of the user's face. This hair growth direction information 1120 for each facial region may be stored with the user's profile (such as in data storage 1077). Consequently as described herein, when the shaving stroke direction information (from stroke event information 1118, for example) is determined for a particular facial region that stroke direction information can be compared with the hair growth direction information 1120 stored in the user's profile to determine relative stroke direction information 1124—whether or not the stroke direction in that region detected by the razor device 1003 is in the same or opposite direction as the hair growth direction stored in the user's profile—or whether or not the stroke direction in that region is with or against the grain of the hair growth.

FIGS. 19 through 22 provide example dashboard display information provided by the software application graphical user interface 1074 on the computerized and networked user interface device 1080. For example, as shown in FIG. 19, the exemplary dashboard 1240 provided to the user includes a plurality of different types of information. In a first portion of the display 1242 the user is provided with shaving pressure information for each region of the user's face for a particular shave. For example, in the example shown in FIG. 19, the dashboard shows that the sensors detected high shave pressure on the cheek regions and optimal shave pressure in the left neck region and the upper lip region. An additional display 1244 in the dashboard 1244 may provide individual shave information for a particular shave such as the number of shave strokes for the face and the number of shave strokes in the neck region for that shave. Another part of the display 1246 may indicate the time spent shaving for that day's shave while another box 1248 may include cumulative shave event information—that is information depending upon the age of the shave cartridge—based upon information obtained and collected since the shave cartridge has been last replaced. As shown in this example display 1246, for blade performance, the application display indicates the predicted or calculated sharpness of the blades 1248 and the number of shaves detected 1250 for this particular blade cartridge. Finally, in area 1252 the user is provided with the ability to rate the current shave, such as scoring it with a rating between 1 and 5 stars.

Figure 20:
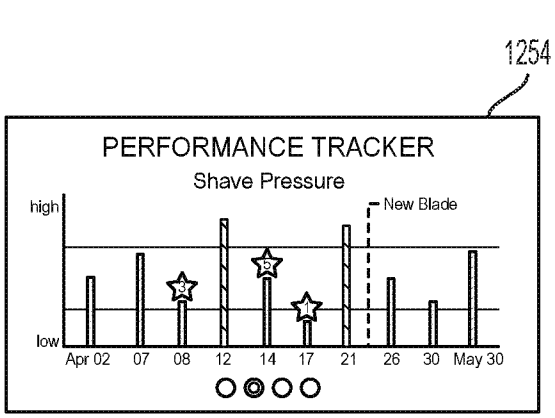
FIG. 20 is an exemplary display according to an embodiment of the current disclosure.

FIG. 20 provides an example dashboard display 1254 that shows shave event data over a period of time such as the date of each shave on a time-line along with the pressure and (if provided) rating for that shave. For example, the shave performed on April 8 had relatively low pressure and a mediocre star rating while the shave performed on April 14 had a higher pressure and a high star rating. This table also provides an indication of when a new blade cartridge has been attached to the handle between April 21 and 26.

Figure 21:
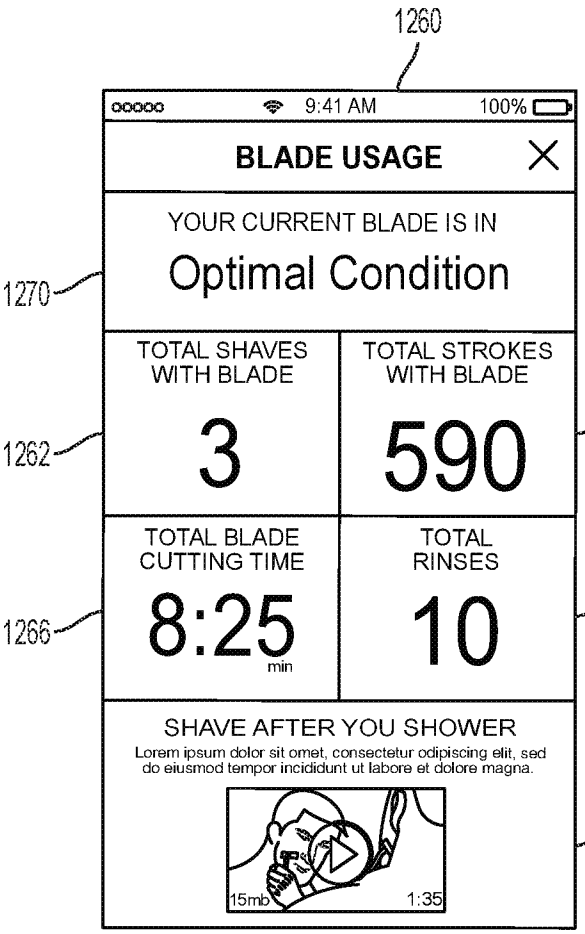
FIG. 21 is an exemplary graphical user interface screen of a software application according to an embodiment of the current disclosure.

FIG. 21 provides another example dashboard display 1260 that illustrates primarily cumulative shave event information, i.e., blade usage information. For example, the dashboard 1260 may include a window 1262 indicating the number of shaves with the current cartridge, may include a window 1264 indicating the number of shave strokes with the current cartridge, may include a window 1266 indicating the total blade cutting time for a current cartridge, and may include a window 1268 that indicates the total number of rinses detected for a current cartridge, and may include a window 1270 that indicates a predicted or calculated blade condition notification. As also provided in this example screen 1260 the application has the ability to provide advice to the user such as through images, texts and/or videos. Consequently, in this screen 1260 a window 1272 allows the user to start a video providing advice for certain aspects of the shave. The ability for the current disclosure to select the appropriate advice based upon the shave event data, the cumulative shave event data and the user profile data will be explained in further detail below.

Figure 22:
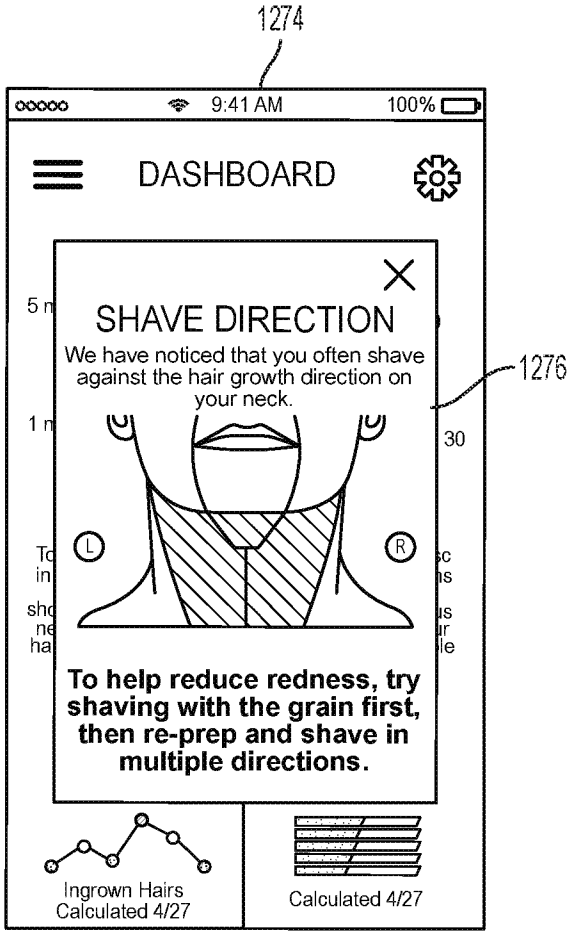
FIG. 22 is an exemplary graphical user interface screen of a software application according to an embodiment of the current disclosure.

As shown in FIG. 22, another example display 1274 for the software application may include a window 1276 indicating relative shave direction information for selected regions of the user's face—that is, whether or not the user's shave direction is with or against the grain of the user's facial hair. As shown in the example window 1276, the application detected that at least in the left and right neck regions, that the user's shave direction is against the hair growth direction (stored in the user's profile) and then provides advice to help reduce redness by advising the user to try shaving with the grain first and then re-prep and shave in multiple directions thereafter.

While the dashboard displays discussed above with respect to FIGS. 19-22 are represented as being displayed by the graphical user interface 1074 provided by the software application 1073 running on the computerized and networked user interface device 1080, it is within the scope of the current disclosure that any of such displays (or similar versions of such) may be displayed by the display 1064 provided on the base station 1301. It is also within the scope of the current disclosure that such information provided by such dashboard displays discussed above with respect to FIGS. 19-22 may be communicated to the user through other electronic communication avenues such as, without limitation: via email, text message, voice-message (such as through the computerized and networked user interface device 1080 and/or through the sound actuator 1066 provided on the base station 1301) and the like.

Figure 23:
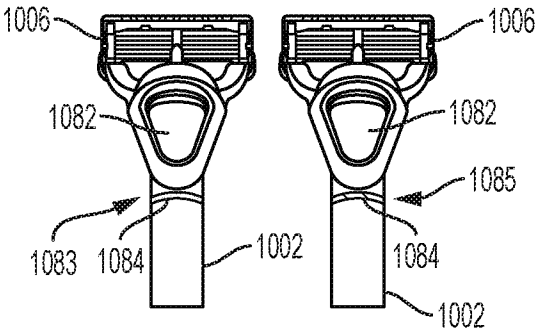
FIG. 23 provide two exemplary razor devices of FIG. 10, each respectively activating a handle-mounted illumination device in different colors or lighting levels.

As shown in FIGS. 10 and 23, the razor handle 1002 may include an illumination device 1084 such as a multicolor LED for indicating subsets of information that may have been otherwise presented by the dashboard displays. For example, as shown in FIG. 23, the illumination device 1082 may illuminate a first color (e.g., green) 1083 when the sensors and associated circuitry detect that the shaving pressure is optimal and a second color (e.g., yellow or red) 1085 when the sensors and associated circuitry detect that the shaving pressure is higher than an optimal range. Likewise, the illumination device 1082 may illuminate a first color (e.g., green) 1083 when the sensors and associated circuitry determine, based upon cumulative shave event information, that the shaving cartridge is in optimal condition and a second color (e.g., yellow or red) 1085 when the sensors and associated circuitry determine that, based upon cumulative shave event information, the sharpness of the blades on the shaving cartridge is outside an optimal range. Similarly, the illumination device can be adapted to illuminate different illumination levels such as illumination brightness, illumination size, numbers of illuminators, various illuminated images, and the like rather than having different colors. Of course, it is also within the scope of the current disclosure that such illumination device may be on the base station 1301 instead of, or in addition to on the handle 1002. It is also within the scope of the current disclosure that, in place of, or in addition to illumination devices, vibrating devices may be provided in the handle to emit differing levels or sequences of vibration depending upon the type of information to be communicated to the user through the handle.

Another aspect of the current disclosure is that the computerized tool to generates feedback information and suggestions for addressing shaving problems (user-identified or otherwise), where such feedback information and suggestions may be based upon relative shave direction information, cumulative shave event information (corresponding to blade wear information), user profile information, facial region information, shaving pressure information, shaving stroke count information, and the like. The feedback information and suggestions may be provided to the user via the graphical user interface 1074 of the software application 1073 in the form of videos, animations, voice messages, images, text messages and the like. Alternatively, the feedback information may be provided by any other communication method as described herein.

For example, as discussed above, the user may identify through the graphical user interface 1074 of the software application 1073 his/her "biggest issues" for shaving, such as "closeness/missed hairs" or "redness". For each of these potential problems identified by the user, the software application 1073 checks relative shave direction information, cumulative shave event information (corresponding to blade wear information), user profile information, facial region information, shaving pressure information, shaving stroke count information, and the like; and based upon predetermined logic and/or upon other processing such as artificial intelligence, will provide messages, videos, images, and/or other information to suggest changes or modifications to the shaving behavior. For example, sometimes the message may simply be "it's time to change your shaving cartridge" or "try skipping days between shaving" or "view this video on beard hydration for shaving" or "try shaving with the grain" or "try shaving with fewer shaving strokes." User feedback based upon shaving direction information (with or against the grain) may be an example where the software tool references both shaving event information (derived from sensor data) in combination with information that may be stored with the user's profile (user-provided beard growth direction information, see FIGS. 17 & 18). User feedback based upon hydration may be another example where the software tool references both shaving event information (derived from sensor data) in combination with information that may be stored with the user's profile (user-provided information indicating when/where the user typically shaves—for example, "before I shower," see FIG. 13). Any such feedback information may be provided through the graphical user interface 1074, through the base station 1301, through the shaving appliance 1003 itself, via email, text message, social network post/message, change in illumination colors or levels, through change in vibration levels or sequences, through coupons (either printed or electronic) and the like. It is also within the scope of the disclosure that such feedback information need not be based upon any user-recognized shaving problems. For example, the feedback information may be requested or un-requested, expected or unexpected.

Another aspect of the current disclosure is the software tool's ability to learn a user's usual shaving behaviors and then adjust the analysis and recommendations over time based upon this knowledge. For example, with respect to recommending shaving cartridge replacement, the logic may be able to assess the user's patterns over days and weeks (over several cartridge changes) to be able to accurately personalize the replacement recommendations. For example, combining the learned pattern behavior over time with information about the days that shaving occurs, the time taken to shave, the number of strokes taken, the blade contact time with the skin, the distance traveled by the blade, etc., the logic will be better able to predict or calculate an appropriate time for a cartridge replacement recommendation.

The ability to learn from the user's behavior patterns may also be used in other ways. For example, if the user typically accesses the software application 1073 at certain times of the day, the logic may be adapted to trigger certain notifications to the user around that time. Similarly, if the logic has access to data indicating the typical day/time that the user may be inclined to shop for shaving supplies, the software application 1073 may be adapted to trigger cartridge replacement notifications shortly in advance of that time and/or may communicate coupons or offers to the user to help influence the purchasing decision. Similarly, the system may be configured to operate with e-commerce applications or software that allows the user to order more cartridges from the software application 1073 (or through other applications or software) when it is time.

Similarly, the notification to the user of optimal versus high/low pressure shaving sensed by the system may change over time based upon learning a user's preferences and shaving behaviors. For example, over time, the logic may learn that the user experiences a better shave at higher shaving loads versus lower shaving loads (See FIG. 20 and associated discussion); and consequently, the shaving load notifications (as described with respect to FIG. 23, for example, and/or with respect to window 1242 in FIG. 19) may be adjusted over time to account for this knowledge.

An exemplary environment for implementing various aspects of the current disclosure may include a computer (or computerized device 1080 and/or computer server(s) 1076) as described herein) that includes a processing unit, a system memory and a system bus. The system bus couples system components including, but not limited to, the system memory to the processing unit. The processing unit may be any of various commercially available processors or may be custom or specially designed processors. Dual microprocessors and other multi-processor architectures may also be employed as the processing unit. Shared processors and/or cloud-based processing may also be implemented.

The system bus may be any of several types of bus structure that may further interconnect to a memory bus (with or without a memory controller), a peripheral bus, and a local bus using any of a variety of commercially available bus architectures. The system memory may include read only memory (ROM) and/or random access memory (RAM). A basic input/output system (BIOS) may stored in a non-volatile memory such as ROM, EPROM, EEPROM, which BIOS contains the basic routines that help to transfer information between elements within the computer, such as during start-up. The RAM may also include a high-speed RAM such as static RAM for caching data.

The computer's memory devices and their associated computer-readable media may provide nonvolatile storage of data, data structures, computer-executable instructions, and so forth. For the computer, the drives and media accommodate the storage of any data in a suitable digital format. Although the description of computer-readable media above refers to a hard-disk drive (HDD) or the like, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, may also be used in the exemplary operating environment, and further, that any such media may contain computer-executable instructions for performing the methods of the current disclosure.

A number of program modules may be stored in the drives and RAM, including an operating system, one or more application programs, other program modules and program data. All or portions of the operating system, applications, modules, and/or data may also be cached in the RAM. It is appreciated that the embodiments disclosed herein may be implemented with various commercially available operating systems or combinations of operating systems.

It is within the scope of the disclosure that a user may enter commands and information into the computer through one or more wired/wireless input devices, for example, a touch screen display, a keyboard and/or a pointing device, such as a mouse. Other input devices may include a microphone (functioning in association with appropriate language processing/recognition software as known to those of ordinary skill in the technology), an IR remote control, a joystick, a game pad, a stylus pen, eye-tracking, or the like. These and other input devices are often connected to the processing unit through an input device interface that is coupled to the system bus, but may be connected by other interfaces, such as a parallel port, an IEEE 1394 serial port, a game port, a USB port, an IR interface, Bluetooth, etc.

The computer may operate in a networked environment using logical connections via wired and/or wireless communications or data links to one or more remote computers. For example, the computerized device 1080 may operate in a networked environment with one or more server(s) 1076. The remote computer(s) 1076 may be a workstation, a server computer, a router, a personal computer, a portable computer, a personal digital assistant, a cellular device, a microprocessor-based entertainment appliance, a peer device or other common network node, and may include many or all of the elements described relative to the computer. The logical connections or data links epicted could include wired/wireless connectivity to a local area network (LAN) and/or larger networks, for example, a wide area network (WAN). Such LAN and WAN networking environments are commonplace in offices, and companies, and facilitate enterprise-wide computer networks, such as intranets, all of which may connect to a global communications network such as the Internet. For the purposes of the current disclosure a data link between two components may be any wired or wireless mechanism, medium, system and/or protocol between the two components, whether direct or indirect, that allows the two components to send and/or received data with each other.

The computer may be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi (such as IEEE 802.11x (a, b, g, n, etc.)) and Bluetooth™ wireless technologies. Thus, the communication may be a predefined structure as with a conventional network or simply an ad hoc communication between at least two devices.

The system may also include one or more server(s) 1076. The server(s) may also be hardware and/or software (e.g., threads, processes, computing devices). The servers may house threads to perform transformations by employing aspects of the invention, for example. One possible communication between a client and a server may be in the form of a data packet adapted to be transmitted between two or more computer processes. The data packet may include a cookie and/or associated contextual information, for example. The system may include a communication framework (e.g., a global communication network such as the Internet) that may be employed to facilitate communications between the client(s) and the server(s).

The data storage device(s) 1077 may be in the form of, or include databases. For the purposes of the current disclosure a "database" is any organized collection of data in electronic form (e.g., accessible by a computer), set up in a manner so that computer(s) can access the data stored in the database through appropriate operation of computer software.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While embodiments of the current disclosure have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A networked shaving appliance system comprising:

a shaving appliance including, a handle and a shaving head cartridge connected to the handle, motion, orientation, and pressure sensors associated with one or more of the handle and shaving head cartridge, and a sensor circuit connected via a data connection to receive sensor signals from the motion, orientation and pressure sensors, the sensor circuit generating shave event information from the sensor signals;

a network circuit wirelessly connected with a computer network, and communicating at least the shave event information to the computer network; and a computerized tool operating, at least in part, on a computerized user device connected to the computer network, the computerized tool configured to, receive shave event data associated with a user of the computerized device from the computer network, receive user profile and user provided shaving session experience data from the user via a graphical user interface provided by the computerized tool, wherein the shaving session experience data includes shaving issues identified by the user, processing the shave event data with the user profile and user provided shaving session experience data to generate user feedback information to improve user shaving experience, and communicate the user feedback information to the user via the graphical user interface provided by the computerized tool.

2. The networked shaving appliance system of claim 1, wherein:

the sensor circuit further generates new cartridge event information; and the sensor circuit compiles cumulative shave event data occurring since the generation of the new cartridge event information.

3. The networked shaving appliance system of claim 2, wherein at least one of the sensor circuit and the computerized tool generates blade wear information based, at least in part, upon the cumulative shave event data.

4. The networked shaving appliance system of claim 3, wherein the computerized tool processes the blade wear information with the user profile data to generate user feedback information.

5. The networked shaving appliance system of claim 4, wherein the user feedback information includes suggestions for addressing the shaving issues determined at least in part upon the blade wear information.

6. The networked shaving appliance system of claim 5, wherein:

the user profile information received from the user includes hair growth direction information;

the sensor circuit generates shave stroke direction information from the sensor signals; and the computerized tool generates user feedback information based further upon the shave stroke direction information with respect to the hair growth direction information.

7. The networked shaving appliance system of claim 6, wherein the user feedback information includes suggestions for addressing the shaving issues determined at least in part upon the blade wear information in combination with the shave stroke direction information with respect to the hair growth direction information.

8. The networked shaving appliance system of claim 5, wherein the shaving problem issues provided by the user further includes at least one of redness, missed hairs, and shave closeness.

9. The networked shaving appliance system of claim 1, wherein:

the user profile information received from the user includes hair growth direction information;

the sensor circuit generates shave stroke direction information from the sensor signals; and the computerized tool generates user feedback information based further upon the shave stroke direction information with respect to the hair growth direction information.

10. The networked shaving appliance system of claim 1, wherein:

the sensor circuit segments at least some of the shave event information based upon one of a plurality of facial regions in which the sensor signals were generated, and identifies facial regions associated with at least some of the shave event information;

at least some of the user profile data is segmented based upon the plurality of facial regions; and the computerized tool generates user feedback information based, at least in part upon facial regions identified in the shave event information.

11. The networked shaving appliance system of claim 10, wherein the facial regions include:

at least one cheek region;

at least one neck region;

at least one chin region; and at least one upper lip region.

12. The networked shaving appliance system of claim 1, wherein the computerized tool is configured to assess and learn behavior as well as user experience over time.

13. The networked shaving appliance system of claim 1, wherein the computerized tool is configured to utilize at least one of artificial intelligence and predetermined logic.

14. The networked shaving appliance system of claim 1, wherein the session experience data provided by the user further includes the user's rating of the current shave.

15. The networked shaving appliance system of claim 1, wherein the user feedback includes at least one of an indication to change shaving cartridges, to modify session frequency, to view an instructional video, to modify shaving patterns, and to modify session timing.

16. The networked shaving appliance system of claim 1, wherein the graphical user interface is provided to the user by at least one of email, text message, social network post, social network message, change in illumination of colors, and change in illumination of levels.

* * * * *